US009291416B2

(12) United States Patent
Würkner

(10) Patent No.: US 9,291,416 B2
(45) Date of Patent: Mar. 22, 2016

(54) LOCKING DEVICE FOR A FIREARM AND FIREARM

(71) Applicant: Gerald Würkner, Enzesfeld (AT)

(72) Inventor: Gerald Würkner, Enzesfeld (AT)

( * ) Notice: Subject to any disclaimer, the term of this patent is extended or adjusted under 35 U.S.C. 154(b) by 0 days.

(21) Appl. No.: 14/423,714

(22) PCT Filed: Jul. 31, 2013

(86) PCT No.: PCT/AT2013/050150

§ 371 (c)(1),
(2) Date: Feb. 25, 2015

(87) PCT Pub. No.: WO2014/032067

PCT Pub. Date: Mar. 6, 2014

(65) Prior Publication Data

US 2015/0204628 A1 Jul. 23, 2015

(30) Foreign Application Priority Data

Aug. 29, 2012 (AT) ..... A 939/2012

(51) Int. Cl.

| | |
|---|---|
| ***F41A 17/20*** | (2006.01) |
| ***F41A 17/54*** | (2006.01) |
| ***F41A 17/02*** | (2006.01) |
| ***F41A 17/22*** | (2006.01) |

(Continued)

(52) U.S. Cl.

CPC ..... *F41A 17/54* (2013.01); *F41A 17/02* (2013.01); *F41A 17/22* (2013.01); *F41A 17/06* (2013.01); *F41C 33/02* (2013.01)

(58) Field of Classification Search

CPC ..... F41A 17/02; F41A 17/066; F41A 17/42; F41A 17/74; F41A 17/04

USPC ..... 42/70.01–70.11, 66

See application file for complete search history.

(56) References Cited

U.S. PATENT DOCUMENTS

| | | | |
|---|---|---|---|
| 4,833,811 | A | 5/1989 | Wilkinson |
| 5,361,525 | A | 11/1994 | Bowes |
| 5,517,780 | A | 5/1996 | Haber et al. |

(Continued)

FOREIGN PATENT DOCUMENTS

| | | |
|---|---|---|
| DE | 4300532 | 7/1994 |
| DE | 29516533 | 3/1996 |

(Continued)

OTHER PUBLICATIONS

Search Report for PCT/AT2013/050150, mailed Novemver 22, 2013.
Search Report from Austrian patent application A 939/2012, mailed Dec. 14, 2012.

*Primary Examiner* — Michael David

(74) *Attorney, Agent, or Firm* — Joseph E. Maenner; Maenner & Associates, LLC

(57) ABSTRACT

The invention relates to a blocking device for firearms, wherein a locking unit is mounted on the firearm, wherein the locking unit comprises at least one blocking mechanism and at least one activation element, wherein the activation element is coupled to the triggering mechanism of the firearm in such a manner that in a locked position or locked mode of the activation element the triggering mechanism is blocked for triggering a shot, and in an active position or active mode of the activation element the triggering mechanism can be released, wherein the activation element can be brought into the active position or active mode only by using an unlocking element blocked position.

22 Claims, 13 Drawing Sheets

(51) Int. Cl.
*F41A 17/06* (2006.01)
*F41C 33/02* (2006.01)

(56) References Cited

U.S. PATENT DOCUMENTS

| | | | | |
|---|---|---|---|---|
| 6,301,815 | B1 | 10/2001 | Sliwa | |
| 6,412,207 | B1 * | 7/2002 | Crye | F41A 17/02 42/70.01 |
| 6,474,011 | B1 | 11/2002 | Sato | |
| 6,941,692 | B1 | 9/2005 | Krinke | |
| 2002/0112390 | A1 | 8/2002 | Harling et al. | |
| 2003/0070343 | A1 | 4/2003 | Glock | |
| 2003/0213159 | A1 * | 11/2003 | Cutini | F41A 17/46 42/70.06 |
| 2004/0111945 | A1 | 6/2004 | Glock | |
| 2006/0048425 | A1 * | 3/2006 | Frickey | F41A 19/09 42/69.01 |
| 2013/0019510 | A1 * | 1/2013 | Kemmerer | F41A 17/20 42/1.01 |
| 2013/0019512 | A1 * | 1/2013 | Kemmerer | F41A 17/066 42/70.05 |
| 2013/0125441 | A1 * | 5/2013 | Westwood | F41A 17/02 42/70.05 |

FOREIGN PATENT DOCUMENTS

| | | |
|---|---|---|
| DE | 4446020 | 6/1996 |
| DE | 202008013964 | 8/2009 |
| WO | WO 2011154858 | 12/2011 |

* cited by examiner

DETAIL Z

E-E

LOCKING DEVICE FOR A FIREARM AND FIREARM

BACKGROUND OF THE INVENTION

1. Field of the Invention

The invention concerns a locking device for firearms for enabling releasable locking by blocking or interrupting the triggering mechanism of a firearm, wherein the locking device features a locking unit arranged on the firearm, wherein the locking unit comprises at least one locking mechanism, and wherein the locking device further comprises a release element embodied as separate from the firearm.

The invention further concerns a firearm having such a locking device.

2. Description of the Related Art

The object of locking firearms so that they can be used only by the authorized owner has already resulted in various shut-off devices. Most of these blocking devices, such as are described in EP 1 443 295 B1 or DE 100 52 466 C1, are characterized in that, in cases of emergency, the unlocking process takes far too long and once a firearm has been unlocked it will remain permanently unlocked until it is locked again manually. As a result, neither a rapid availability nor the exclusive use by its owner is ensured, since a firearm that is unlocked can easily fall into the wrong hands as a result of carelessness or hand to hand fighting and can therefore also be used against its owner.

To solve this problem, thus far primarily methods have been proposed in which, using radio technology, communication is enabled between a transmitter and a receiver to initiate the activation of the firearm, as is described in the US 2003/0070343 A1, DE 44 46 020 A1 or US 2002/0112390 A1. The disadvantages of these proposals are that, on the one hand, electronic systems that are accident-prone due to the strong concussions need to be installed in a firearm, and it is always necessary to guarantee an adequate supply of power, which occasionally inhibits usability of the firearm, and particularly, that a deliberate deactivation can be implemented by disrupting the identification signal using interfering transmitters, so-called jammers. Based upon these problem areas, users feel they cannot trust these approaches and, as a result, they have not gained acceptance. Fingerprint sensors have not become established for similar reasons.

An older mechanical approach attempts to solve the problem by ensuring that a firearm will remain activated as long as a pin or a key is inserted in it, wherein said pin or key is connected by a cord to the possessor of the firearm and is removed as soon as the firearm is stolen, as in U.S. Pat. No. 4,833,811 A and U.S. Pat. No. 5,361,525 A. However, these approaches are unsuitable for many applications, because anyone who comes close enough to the possessor of the firearm can deactivate the firearm by pulling the cord. Therefore, these proposals also have never gained significance.

Also known from DE 43 00 532 A1, U.S. Pat. No. 6,474,011 B1, WO 2011/154858 A1 and AT 412823 B are locking devices for firearms in which a release element directly determines the status of the weapon. Furthermore, from DE 202008013964 U1, a locking mechanism is known, in which a metal block blocks a barrel or a magazine well of a weapon to prevent disassembly.

The use of a key for locking and/or releasing a firearm as described above is also known from DE 43 00 532 A1.

BRIEF SUMMARY OF THE INVENTION

Hence, the primary object of the invention is to create a locking device for firearms that will allow a firearm to be assigned to a user in a robust and reliable manner and that will block or prevent the use of the firearm in the case of loss or theft.

This object is achieved by means of a locking device of the aforementioned kind, wherein, according to the invention the locking unit further features at least one activation element that is actuable by a user, wherein the activation element is coupled to the triggering mechanism of the firearm in such a way that 1. When the activation element is in a locked position or in a locked mode, the triggering mechanism for firing a shot is blocked, and
2. When the activation element is in an active position or in an active mode, the triggering mechanism can be released, and wherein, when the locking mechanism is in a locking mode, the activation element is blocked from moving or being moved out of the locked position or locked mode into the active position or active mode, and wherein the locking mechanism has a locking mechanism coupling region, and wherein the release element has a release element coupling region corresponding thereto, and wherein the locking mechanism switches from the locking mode to a released mode when the two coupling regions are coupled, so that, for the duration of the released mode, the activation element can be switched by the user from the locked position or locked mode which blocks or interrupts the triggering mechanism of the firearm to an active position or active mode which releases the triggering mechanism of the firearm.

The aforementioned problem is further solved by a method for releasing a lock on a triggering mechanism of a firearm, wherein the locking device has a locking unit arranged on the firearm, wherein the locking unit comprises at least one locking mechanism, and wherein the locking device further comprises a release element embodied as separate from the firearm, and wherein the locking unit further has at least one activation element that is actuable by a user, wherein the activation element is coupled to the triggering mechanism of the firearm such that 1. When the activation element is in a locked position or a locked mode, the triggering mechanism for firing a shot is blocked, and
2. When the activation element is in an active position or in an active mode, the triggering mechanism can be released, and wherein, when the locking mechanism is in the locking position, the activation element is blocked from moving or being moved out of the locked position or locked mode into the active position or active mode, and wherein the locking mechanism has a locking mechanism coupling region, and wherein the release element has a release element coupling region corresponding thereto, comprising the following steps:

coupling the two coupling regions so that the locking mechanism alternates from the locking mode to a release mode, and the user switching the activation element, for the duration of the release mode, from the locked position or locked mode which blocks or interrupts the triggering mechanism of the firearm to an active position or active mode which releases the triggering mechanism of the firearm.

The advantage of the present invention is that, the weapon can be fired only when this activation element is actuated, e.g., is held down (i.e., is in the so-called active position/the so-called active mode). If the activation element is not actuated, e.g., held down, the weapon cannot be fired, i.e., the trigger cannot be actuated, or actuation of the trigger will not fire a shot. Additionally, the activation element can be switched to the active position only when it has been released by a release element, which is embodied as separate from the firearm.

The following application scenario can therefore be implemented, for example: the release element is located in a holster, which is worn by the user on his body, for example. When the weapon is placed in this holster, the activation element can be actuated. When the user intends to use the weapon, he actuates the activation element before drawing the weapon from the holster, by holding the activation element down, and draws the weapon. As long as the activation element is pressed down, the weapon can be fired.

If the weapon is knocked out of the hand of the user, for example, the user will necessarily let go of the activation element, which then is no longer pressed down, and the weapon can no longer be fired. The weapon also can no longer be fired because the activation element is no longer in the active position.

Thus an "enemy" cannot fire the weapon. Only when the weapon has been returned to the holster can the activation element be pressed down again, etc. No activation element to be actuated by the user is known from the above-cited prior art.

The use of a key for locking and/or unlocking a firearm is known from DE 43 00 532 A1. The key corresponds to the release element of the present invention; this key can be used to unlock a locking unit on the firearm of DE 43 00 532 A1, which comprises a locking mechanism. The triggering mechanism can be locked and/or unlocked using this locking mechanism.

In the present invention, in contrast, the locking mechanism blocks actuation of the activation element and the triggering mechanism is released only when the activation element is actuated and the actuation maintained.

Because no activation element to be actuated by a user is provided in DE 43 00 532 A1, the disadvantage results that the key must be fastened to the user by means of a cord, for example; otherwise, if the weapon were to be wrested from the user, the key would not be removed and the weapon would still be usable.

With the present invention, in contrast, the authorized user, in other words, the person who activates the weapon, has full range of motion.

The features according to the invention generally result in a situation in which, as long as the locking mechanism is in the locking mode, the firearm cannot be fired, because in this locking mode, the triggering mechanism is locked against use either by blocking the transmission of the trigger impulse at any point on the triggering mechanism or by interrupting the transmission of the trigger impulse at any point. One characteristic of these features is that, once the locking unit has been switched to the release mode by the release element, the firearm remains continuously in a state which will allow a shot to be fired as long as the firearm is held in the hand, and thus by the person who switched it to the release mode, since the hand, which is preferably situated on the firearm grip, is a precondition for the activation element remaining in the active position or active mode. Any interruption of holding the firearm in the hand will cause the activation element to switch to a locked position or locked mode, and as a result, firing of a shot will be continuously prevented until a reactivation is initiated by means of the release element.

This will ensure that only the person who is in possession of the release element can use the firearm, and any other person who comes into possession of the firearm, be it by chance or intentionally, will not be able to fire a shot. One key advantage of this is that these features can be implemented even through purely mechanical means and without any electronics, which makes them very robust. If the features are achieved using electronic components, the two coupling regions can be coupled by means of any kind of technology or method that is capable of implementing identification via the coupling, and the activation element can apply any kind of technology or method that is capable of detecting a hand on the weapon.

In one advantageous variant of the invention, it is provided that the first coupling region is designed as an opening region and the second coupling region is designed at least as a sub-region of the release element, wherein the two coupling regions cooperate by inserting the sub-region of the release element into the opening region. This allows a particularly simple joining and/or cooperation between the release element and the locking mechanism.

It can further be provided that the locking unit can be mounted on the firearm, thereby allowing existing firearms to be retrofitted with the locking device of the invention.

In an alternative variant, the locking unit is integrated into the firearm, which enables a particularly simple realization of a compact and cost-effective design. Integrating the locking unit into the firearm also provides better protection of the locking unit against possible attempts at manipulation. To prevent attempts at manipulation, a predefined breaking point can also be integrated into the locking unit, so that any attempts at manipulation involving strong forces will destroy the locking unit at designated points without invalidating the locking function. Moreover, the space in which the locking unit is installed can also be used for other applications, if necessary, which makes the development of a corresponding firearm form more economical.

In a preferred embodiment, the firearm features an opening into which the release element can be inserted at least in the first coupling region in order to interact with the locking unit. Based upon the design of the opening region, a possible release element is thereby pre-selected, because the shapes of the opening region and the release element must be compatible in order to create a safety barrier. In addition, the sensitive area in which the coupling regions are coupled, whether by mechanical or some other means, e.g. electronic, is provided with additional protection.

In a robust, mechanical embodiment, the locking mechanism is preferably designed with a mechanical lock. Mechanical locks are considered an established and well developed technology and are not functionally impaired by the stresses and strains that can occur on a firearm. The use thereof in this application is therefore advantageous.

To ensure that the lock will offer a high level of security, in a preferred variant the lock is designed as a pin lock. Pin locks are the most common technology used in safety catches and as such can be easily adapted in their existing versions to this application. Consequently, existing components may be used, at least in part, and experience with these systems can enter into this application.

To better meet the specific requirements inside a firearm, the pin lock is preferably designed as a linear lock. The design as a linear lock results in a particularly slim construction which can be easily integrated into a firearm, and in a design having very few components, since it is possible to couple directly to the linear movement of the lock with a linear locking motion, e.g. by means of a locking bar.

Under normal circumstances, the release element is arranged on an unlocking unit which can be separated from the firearm, whereby said release element is preferably fastened onto or integrated into the unlocking unit. The unlocking unit is an object which is either connected to the possessor of the firearm in some way or is in the custody of said person.

In a preferred variant, the unlocking unit is implemented as a holster and the release element is arranged therein in such a way that when the firearm is carried in the holster the release element is already coupled with the locking unit. This enables a particularly fast and uncomplicated activation of the firearm for use.

In an alternative variant, the release element is arranged in a storage container. This solution is intended for individuals who are not authorized to carry a firearm in a holster. If the weapon is required for use at home, for example for self-defense, the weapon can be activated directly at the storage container as soon as it is removed therefrom.

In another alternative variant, the release element is arranged in a support device. This solution is ideal at the shooting range, and is therefore particularly ideal for shooting sport.

In a preferred embodiment, the release element is designed as a mechanical release element. Mechanical release elements, particularly in the form of safety keys, are widely used and are considered reliable and robust. They therefore ideally fulfill all requirements placed on a release element in this application, and further allow existing key concepts to be utilized.

In a preferred variant, the activation element is designed as a mechanical sensing element. As a mechanical sensing element, the activation element receives every keying pulse and transmits it as a movement or signal.

In a preferred mechanical embodiment, the activation element is designed as a lever arm. In this manner, the motion of the activation element is implemented as rotational motion by means of an axis. This enables very small activation strokes even with high forces without the risk of canting.

To ensure that the activation element is always shifted automatically to the locked position as soon as the activation pulse is interrupted, it is provided that mechanical embodiments feature an activation element which is moved toward a locked position by means of a spring. This spring force can also be introduced into the locking unit in a suitable location by means of a restoring element.

In the majority of embodiments, the activation element is situated on the firearm grip, because grasping the firearm grip with the hand is part of the normal approach to using a firearm.

If a weapon grip has an external side that faces the palm of a user and an opposite, internal side that is averted from the palm of the user, the activation element can be situated on this internal side. With most firearms, this results in a very compact design, since this creates a physical proximity of the activation element to the other components of the locking unit.

An alternative arrangement in which the activation element is situated on the external side of the grip has the advantage of acceptance by users, because safety devices having a sensing element on the external side of the firearm grip, in the form of smooth roll safeties, are widely used and accepted.

Since, in order to provide the desired level of safety, it is necessary to prevent the simple and rapid disassembly of a firearm to remove the locking device, it is provided that the dismantling mechanism of the firearm is also blocked or locked when the activation element is in the locked position or locked mode.

Many firearms already feature one or more systems which can lock or block the firearm. It is therefore provided that, in such cases, the locking device according to the invention can be coupled to the already existing locking device, wherein the former activates or deactivates the latter. As a result, the effort required to adapt the locking device according to the invention to a respective firearm is reduced, and systems that are already proven and established can continue to be used.

Based upon their specific use, locking devices should generally be implemented so as to ensure that they cannot be easily circumvented or switched off; therefore, in cases in which the firearm body consists mostly of plastic, those components of the locking device of a firearm which are sensitive and susceptible to manipulation should preferably be additionally secured by means of a reinforcement or hardening of the firearm body, especially in the region of the locking mechanism, with the reinforcement being made of a material which is harder than the plastic of the weapon body.

In a particularly preferred solution, the desired functionality is achieved in that the release element is a mechanical key and the locking mechanism features at least one corresponding linear lock and a locking bar, wherein the linear lock consists of a lock base and a linear module which is mounted so as to slide or move along the lock base, wherein the lock base features an opening region which points toward the first coupling region, into which at least one pin of the linear lock projects, each said pin being guided in a respective bored opening, wherein the pin is embodied in two parts, and the respective bored opening extends from the linear module into the lock base, and a respective spring element pushes the at least one pin to a first position in the direction of the opening region, wherein bringing the key into the opening region shifts the at least one pin against the spring force of the spring element into a second position, and in the second position, the separation plane that divides the at least one pin is aligned between the two parts of the pin, parallel to a sliding plane that is located between lock base and linear module, thereby enabling a sliding movement of the linear module so as to release an opening movement, in which the activation element shifts the linear module via the locking bar that is coupled to the activation element, wherein, when the activation element is in the locked position, a trigger which is assigned to the triggering mechanism is blocked in that the locking bar has at least one blocking portion which blocks an actuation of the trigger if the activation element is in the locked position, and releases the actuation of the trigger if the activation element is in the active position. This type of solution allows the desired complex functionality to be achieved extremely easily and through purely mechanical means, making it very robust.

Aside from the purely mechanical solution, the logic according to the invention allows for a number of other possible solutions which employ a variety of electronic components, e.g. sensors. In a preferred electronic embodiment, an ultrasonic sensor is used as the activation element. Ultrasonic sensors can be applied to a firearm grip such that they cannot be disturbed and such that they are able to reliably detect even a temporary greater distance between the hand and the grip as permissible.

In summary, therefore, the present invention solves all of the aforementioned problems by applying a logic which cost-effectively and reliably enables the desired functionality by purely mechanical means. The invention is characterized in that the firearm can be activated only when the individual release element for the respective firearm is coupled to the locking unit of the firearm, wherein the release element is connected to the possessor of the firearm or to an object which is under the control of the possessor, preferably in such a way that, as long as the release element is coupled or in contact with the locking unit, it is very difficult or impossible to use the firearm. The locking device of the firearm is released when the firearm grip is grasped, by means of an activation element, a device which uses the encompassing of the grip by the hand, which initiates the functions of the firearm. As soon as this encompassing is no longer existent, the locking device switches to the locking mode, in which the firearm can no longer be used and can be reactivated and used only after it has been re-coupled to the release element and when the grip is grasped again. The locking device can be a locking device or a safety that is specially installed for this purpose, or one that already exists in the firearm.

Aside from the purely mechanical embodiment, this logic according to the invention enables a large number of additional alternative embodiments. These alternative embodiments can use optical, acoustic or electromagnetic methods for coupling the coupling regions, and this coupling can be implemented by direct contact or within a predetermined distance, wherein in these variants, the locking unit is implemented as an electromechanical application. In the embodiment involving an electromagnetic communication or coupling, the permissible coupling distance can be kept very small and can be shielded by a shielding against interfering signals, thereby preventing a coincidental or deliberate disruption. For the activation element, various electronic and electromechanical embodiments, such as sensors which detect the grasp of the hand on the firearm grip by measuring pressure, brightness, temperature, field interference or distance, are also possible. The invention can be used on or in all types of small arms. Small arms in this context are especially mobile firearms with explosive ammunition, but also all other types of mobile firearms, e.g. those that fire a wide variety of objects, particles, fluids or gases by means of pressure from gases or compressed springs or some other type of acceleration, including those on electrical lines with an electrical charge, such as a Taser.

In the following, the invention will be described primarily in the solution which is preferred by the inventor, which is a purely mechanical embodiment. In this solution preferred by the inventor, the firearm in which the device is shown installed is one of the most widely used pistols, especially by the executive forces, the lock, which forms a part of the locking mechanism of the locking unit, is a mechanical, linear safety lock, the release element is a mechanical safety key, the locking mechanism is a linear, push-actuated locking mechanism, and the unlocking unit, which forms the object to which the key is fastened, is a holster with a mounting device that is matched to the pistol. This solution which is preferred by the inventor will be illustrated and described in more detail in most of the figures. This solution preferred by the inventor is complemented by additional, specific detail solutions for specific applications.

The advantages of the solution preferred by the inventor consist particularly in that the purely mechanical solution enables a highly robust construction which does not require the use of sensitive electronic components and hence can do without a power supply, in that, by using a customary and therefore standardized key logic, existing keys of safety locks, together with the entire motion link logic including the corresponding locking pins, can be used, in that the use of a linear lock enables a very slim construction, and in that the design of the push-actuated locking mechanism largely prevents manipulations to circumvent the blocking, since the blocking function cannot be deactivated by merely severing the locking bar.

DESCRIPTION OF THE DRAWINGS

The invention along with further advantages will be specified in greater detail in the following in the context of several exemplary, non-restrictive embodiments which are illustrated in the respective figures.

The drawings show:

FIG. 2 the position of a complete locking mechanism assigned to the firearm according to FIG. 1 and of a key in the case of a drawn firearm, in a partial section, FIG. 3 a mechanism according to the invention, integrated into the firearm in a deeper partial section with the firearm in the holster, FIG. 4 the isolated, mechanism according to the invention without a firearm, in a partial section, FIG. 5 to FIG. 10 a partial sectional representation of individual modes of the mechanism according to the invention, in the functional sequence, FIG. 11 the isolated mechanism according to the invention without a firearm, in a perspective representation, FIG. 12 a detailed view of a sectional representation of the locking pawl, and a schematic representation of the forces acting thereon, FIG. 13 an exploded view of the construction according to the invention in the weapon, FIG. 14 protection against dismantling of the firearm, in a partial sectional representation, FIG. 15 to FIG. 18 a simple solution with a modified linear lock, wherein FIG. 16 and FIG. 18 show a plan view, FIG. 19 and FIG. 20 a representation of a cylinder lock for the mechanism according to the invention, wherein

DETAILED DESCRIPTION OF THE INVENTION

In what follows, a solution which is preferred by the inventor will first be presented and discussed with reference to FIG. 1 to FIG. 14.

Figure 1:
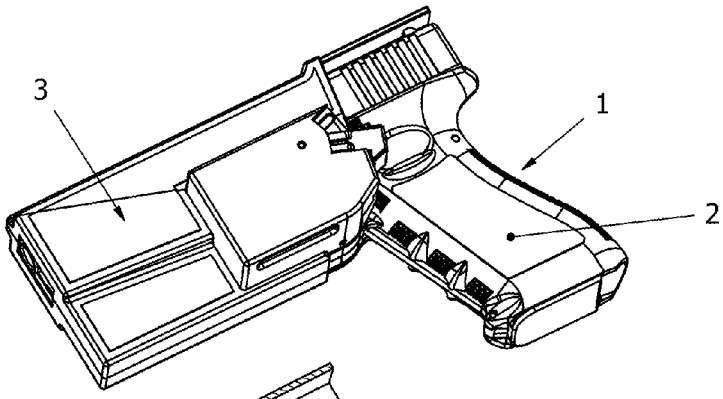
FIG. 1 a perspective view of a firearm as it is carried in a holster.
Figure 2:
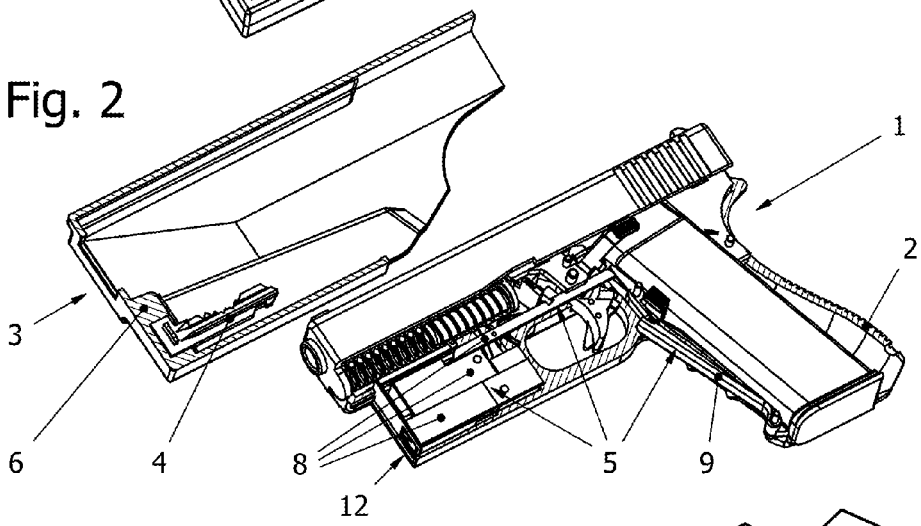
Figure 3:
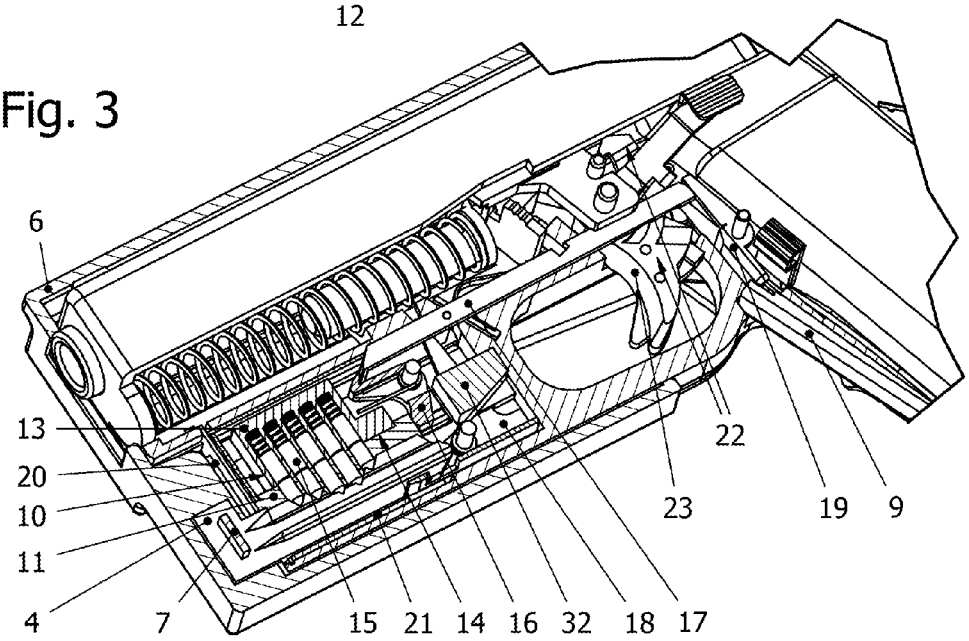

FIG. 1 shows a firearm 1 with a weapon body 2, as it is carried in an unlocking unit 3, designed as a holster. FIG. 2 shows a partial section of the holster 3, with the firearm 1 drawn, having a release element 4, embodied as a mechanical key which is fixed in the holster 3, and the weapon body 2 with a locking unit 5 placed therein. FIG. 3 shows the locking unit 5 in a deeper partial section wherein the firearm 1 is in the holster 3 and hence the key 4 is in the locking unit 5.

In FIG. 2 and FIG. 3, the arrangement of the individual parts of the unlocking unit 3 and the locking unit 5 are depicted. One grouping of the unlocking unit, implemented as a holster 3, comprises a holster body 6 with the key 4, which is firmly connected to the holster body 6 by means of a key mount 7, and another grouping comprises the firearm 1 with the weapon body 2 and the locking unit 5. The locking unit 5 consists of a locking mechanism 8 and an activation element 9. The essential, functional parts of the locking mechanism 8 are a linear lock 10 consisting of a lock base 11 with an opening region 12 in which the key 4 is accommodated, a linear module 13 which is linearly movable, wherein the linear motion thereof along the sliding plane 14 to the lock base 11 is released by means of the key 4, divided locking pins 15 which lock the lock, a locking pawl 16 which, depending on the mode, either releases or blocks a locking bar 17, a restoring element 18, implemented as a fixing lever, which fixes the key 4 in the firearm 1 by hooking and simultaneously fixes the weapon body 2 in the holster 3, and a bell crank lever 19 which deflects the impulse absorbed by the activation element 9 to its own direction of motion. The activation element 9, embodied as a grip lever, receives the pressure of the hand on the grip. The locking mechanism 8 is equipped with components built into the firearm 1, which are locked by a locking panel 20 and the lock is protected by a safety plate 21. Also shown is a part of a triggering mechanism 22, which is a component of the firearm 1 that serves as an example. This triggering mechanism 22 consists of a trigger 23, which has been modified for this preferred solution, and a mechanism which is subordinate to this trigger 23 and is integrated into the firearm 1, and which transmits the trigger impulse of the trigger 23 to a cartridge by means of a mechanism which is not part of this invention, but is part of the respective firearm.

The functioning of the locking mechanism 8 will now be presented and described in detail in the sequence of FIG. 4 to FIG. 12. The isolated mechanism according to the invention is depicted without the firearm 1 in a partial section.

Figure 4:
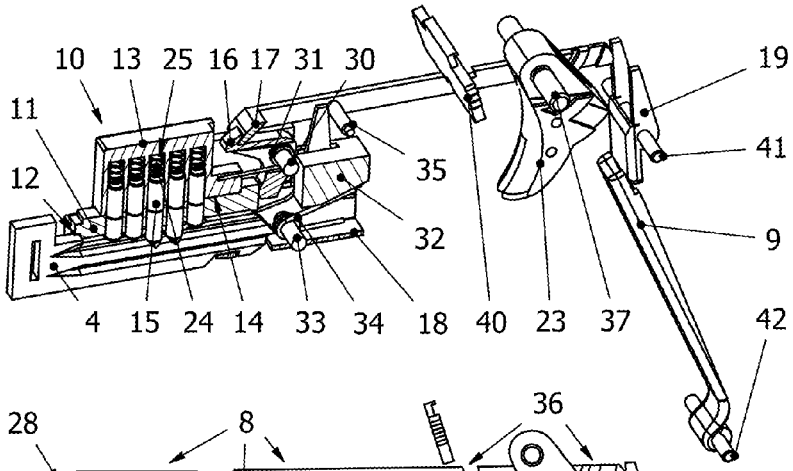
Figure 5:
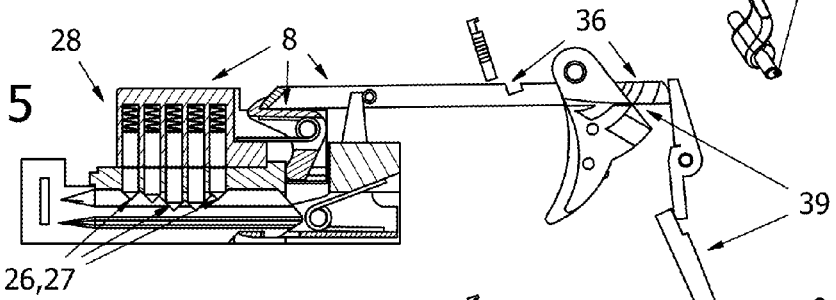
Figure 6:
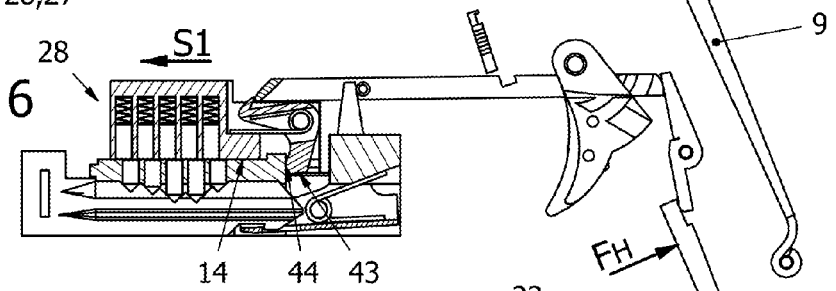
Figure 7:
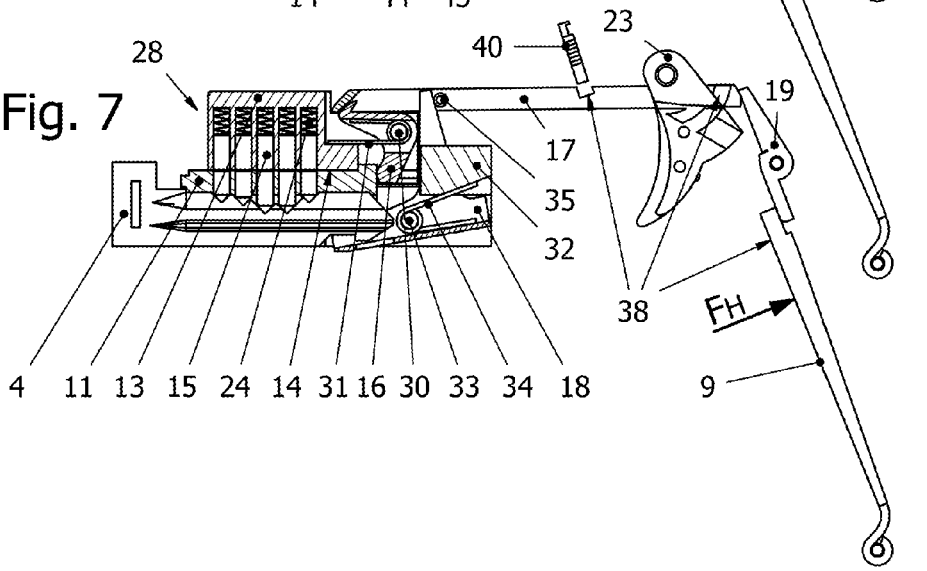
Figure 8:
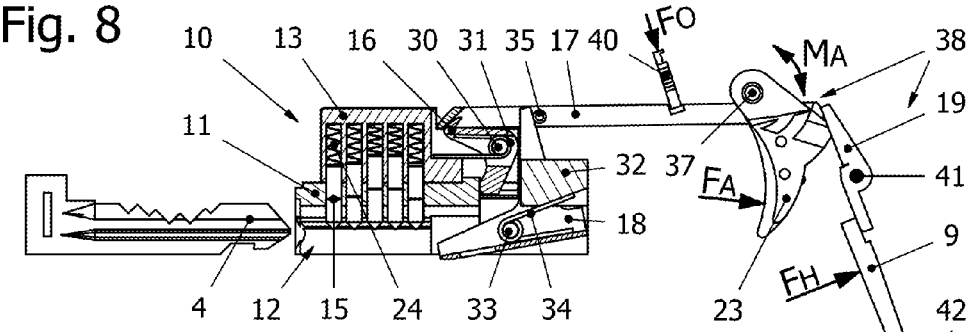

In FIG. 4 to FIG. 7, the firearm 1 is located in the holster 3 as in FIG. 1 and FIG. 3, which means that the key 4 is in the lock base 11. FIG. 4 and FIG. 5 illustrate the same status in different views, wherein FIG. 4, FIG. 7 and FIG. 8 provide an overview of the construction with all of the reference signs, while the other, similar views are largely free of reference signs so as to depict the functionality more clearly.

First, a general description of the isolated systems will be provided:

The linear lock 10 consists of a linear base 11 which is fixed in a housing that is formed by the weapon body 2, into which the key 4 can be inserted in the opening region 12, and the linear module 13 which is connected by grooves to the lock base 11 and can be moved linearly along the sliding plane 14, to the left in the illustration, wherein in the resting position it is pressed toward the right side against a stop. The linear lock 10 is designed as a classic safety lock with divided locking pins 15 and compression springs 24 in bored openings 25, wherein the lower ends of the locking pins 15 form a first coupling region 26 in the lock base 11 and are brought into an unlocked position by means of a second coupling region 27 that is implemented as a motion link on the key 4. Therefore, the two coupling regions 26, 27 are coupled with one another when the key 4 is in the lock base 11, and therefore, the locking mechanism 8 is in the release mode 28. If the key 4 is not in the lock base 11, the two coupling regions are separated, and therefore, the locking mechanism 8 is in a locking mode 29. An axis 30 on which the locking pawl 16 is rotatably mounted is fixed on the linear module 13. A torsion spring 31 exerts a torque on the locking pawl 16 in a clockwise direction, whereby, due to the special form of the locking pawl 16, the linear module 13 is pushed toward the right against the stop of the lock base 11. On the right side next to the lock base 11, a fixing lever assembly 32 is fixed in the housing, which is formed by the weapon body 2, by which assembly the fixing lever 18 is fixed in place so as to rotate around an axis 33. A torsion spring 34 exerts a torque on the fixing lever 18 in a clockwise direction, whereby the locking bar 17, which can only be moved linearly in its longitudinal direction and can be mounted in sliding sleeves if necessary, is pushed to the right by a locking bar tappet 35, and the lower left region of the fixing lever 18 fixes the key 4 in the system by hooking it in the fixing lever 18. The rotatably mounted locking pawl 16 can block or release the linearly displaceable locking bar 17 with a hook. The locking bar 17 contains recesses in the form of a rotational motion link in a blocking portion 36, whereby, depending on the position of the locking bar 17, a rotational movement of the trigger 23 around an axis 37 is or is not released. The release of the rotational movement of the trigger 23 around its axis 37 is understood as an active position 38 of the grip lever 9 which enables the firing of a shot as a result of coupling with the locking bar 17. If the rotational movement of the trigger 23 is not released, this is implemented by a locked position 39 of the grip lever 9, which, due to the coupling with the locking bar 17, does not permit an angle of the trigger 23 that can fire a shot. Smaller angles than those that can fire a shot are also permissible in locked position 39, in order to fix the locking bar 17 in place by the downward movement of the rotational motion link after the unauthorized firing of a weapon. The locking bar 17 further contains a recess which allows or does not allow the actuation of a dismantling mechanism 40, implemented as a locking slide, depending on the position of the locking bar 17. A torque is exerted on the grip lever 9 via the locking bar 17 and the bell crank lever 19, which is mounted so as to rotate around an axis 41, said torque being introduced by the torsion spring 34 via the fixing lever 18 so that the grip lever 9 tends to move counterclockwise around an axis 42 to a stop position.

The Functional Sequence:

FIG. 5 depicts the status of the system in which the firearm 1 is free of external influences or forces in a holster 3 in the carrying position, without a hand on the grip. The system is thus in a resting position. The key 4 is in the lock base 11, and therefore, the locking pins 15 are pushed by the compression springs 24 into the key motion link such that the division of the locking pins 15 forms a plane with the boundary surface and the sliding plane 14 between the lock base 11 and the linear module 13, and therefore, the locking mechanism 8 is in a released mode 28. The locking pawl presses the linear module 13 to the right against the stop of the lock base 11 by means of the torsion spring 31. The locking bar 17 is in the stop position on the right side, whereby the trigger 23 and the locking slide 40 are blocked. The grip lever 9 is at the stop position in the counterclockwise direction, and therefore, the grip lever 9 and the locking bar 17 coupled thereto with the blocking portion 36 are both in locked position 39. The fixing lever 18 is in the stop position and is therefore hooked into key 4. As a result, the firearm 1 is fixed in the holster 3 and cannot fall out.

FIG. 6 illustrates the status of the system in which the firearm 1 in the holster 3 is activated by the grasp of the hand and the pressure consequently exerted on the grip lever 9. By virtue of the force of the hand FH, represented as an arrow, a torque is exerted on the grip lever 9 which presses the locking bar 17 to the left against the pressure of the two torsion springs 31 and 34 by means of the bell crank lever 19, which shifts the locking bar 17 to the left. This is possible only because, as a result of the key 4, the locking pins 15 are in a position in which the division of the locking pins 15 forms a plane with the boundary surface and the sliding plane 14 between the lock base 11 and the linear module 13, whereby the lock is unlocked and the locking mechanism 8 is therefore in a release mode 28, and the linear module 13 is able to move to the left. This stroke is represented by the arrow S1. With this movement, the locking pawl 16 rotates in a counterclockwise direction until it releases the locking bar 17 completely, since the torque which produces a resulting torque in a counterclockwise direction by means of a downward projecting lever 43 of the locking pawl 16, which is supported on a contact area 44 of the lock base 11, turns the locking pawl 16 in a counterclockwise direction. Due to the displacement of the linear module 13, the movement of the lower halves of the locking pins 15 in the axial direction thereof is prevented, whereby the key 4 is fixed in the lock base 11, and whereby the firearm 1 is also fixed in the holster 3. The fixing lever 18 is rotated in a counterclockwise direction by means of the locking bar tappet 35 and thereby opens the fixing of the key 4 by means of its hook.

FIG. 7 illustrates the status of the system in which the firearm 1 is activated in the holster 3 by the grasp of the hand and the pressure exerted thereby on the grip lever 9, which places the grip lever 9 in the active position 38. As a result of the force exerted by the hand, represented as an arrow FH, the grip lever 9 is pushed to the stop, which moves the locking bar 17 as far to the left as possible via the bell crank lever 19. Therefore, the rotational motion link for the trigger 23 and the recess for the locking slide 40 in the blocking portion 36 of the locking bar 17 are in the released position. At this point, the only counterforce is provided by the spring force of the torsion spring 34 via the fixing lever 18 and the locking bar tappet 35. As a result of the torsion spring 31, the locking pawl 16 has rotated back in the clockwise direction into the expansion space behind the contact barrier of the locking bar 17, and has simultaneously brought the linear module 13 back into the stop position on the right side. The axes of the divided locking pins 15 are congruent again, and therefore, the locking pins 15 can also be moved in their axial direction again and the key 4 can be withdrawn. At the same time, the fixing lever 18 has also fully released the hook of the key 4. As a consequence, the firearm 1 can be drawn out of the holster 3.

FIG. 8 depicts the status of the system in which the firearm 1 has been drawn out of the holster 3. As a result of the grasp by the hand and the pressure that is thereby exerted on the grip lever 9, the grip lever 9 remains in the active position 38 and the firearm 1 remains activated. The locking bar 17 is moved as far as possible to the left, which places the rotational motion link for the trigger 23 and the recess for the locking slide 40 in the released position. A trigger pull force, represented by the arrow FA, can then be exerted on the trigger 23, which releases a shot as a result of the torque, represented by the arrows MA. In a similar manner, the locking slide 40 can also be actuated by an opening force, represented by the arrow FO, which allows the firearm 1 to be dismantled. Since the key 4 has been withdrawn, the locking pins 15 have been pressed downward to their stop position by the compression springs 24. As a result, the linear lock 10 is then locked and the linear module 13 can no longer be moved.

Figure 9:
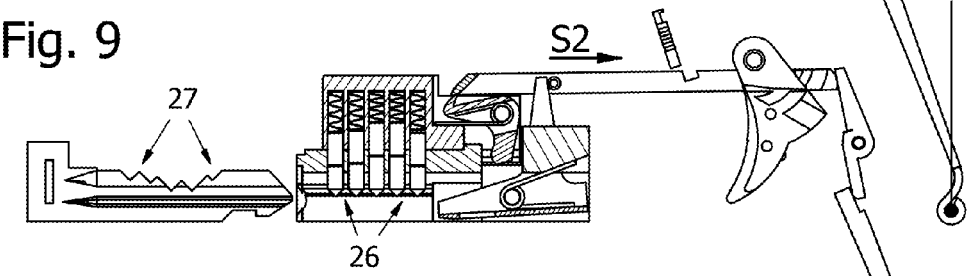

FIG. 9 shows the status of the system in which the weapon 1 has been drawn out of the holster 3, and the grasp by the hand and the resulting pressure that is exerted on the grip lever 9 is interrupted, as would occur, e.g., if the weapon were knocked out of the user's hands. The torque of the torsion spring 34 pushes the locking bar 17 toward the right to the starting position by means of the fixing lever 18; this stroke is represented by the arrow S2. Since the torsion spring 34 exerts a substantially greater torque than the torsion spring 31, the locking pawl 16 is turned in a counterclockwise direction by the contact barrier of the locking bar 17, which moves to the right under the resulting force, until the contact barrier has slipped over the hook of the locking pawl 16 and the locking pawl 16 has turned back in a clockwise direction to the stop position, whereby the contact barrier hooks into the locking pawl 16.

Figure 10:
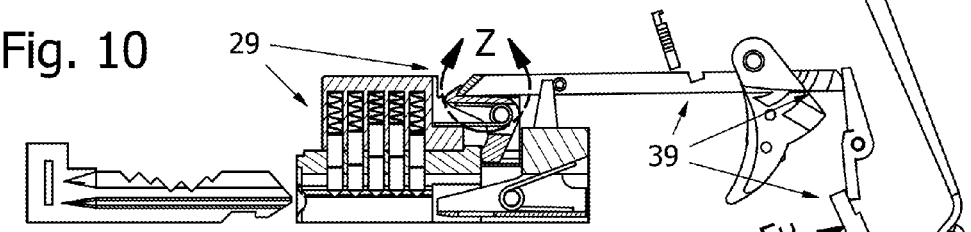
Figure 12:
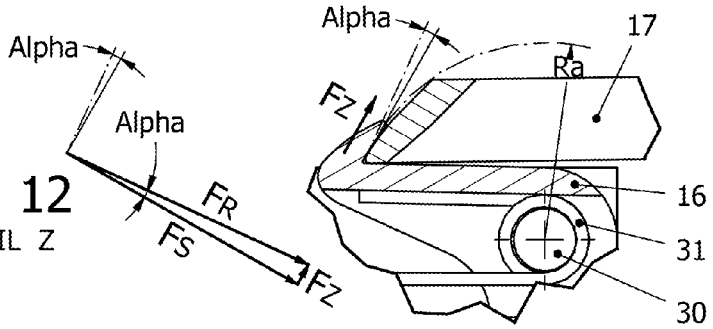
Figure 13:
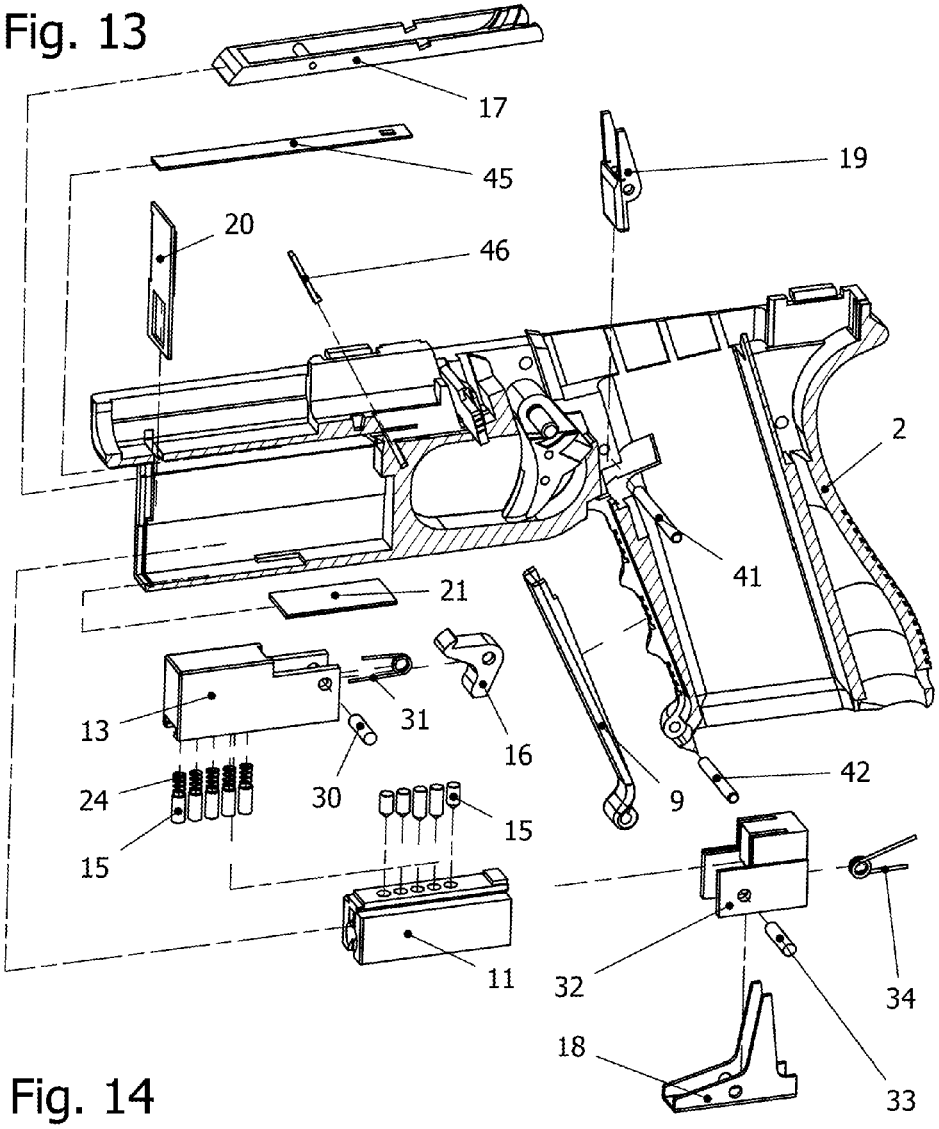
Figure 14:
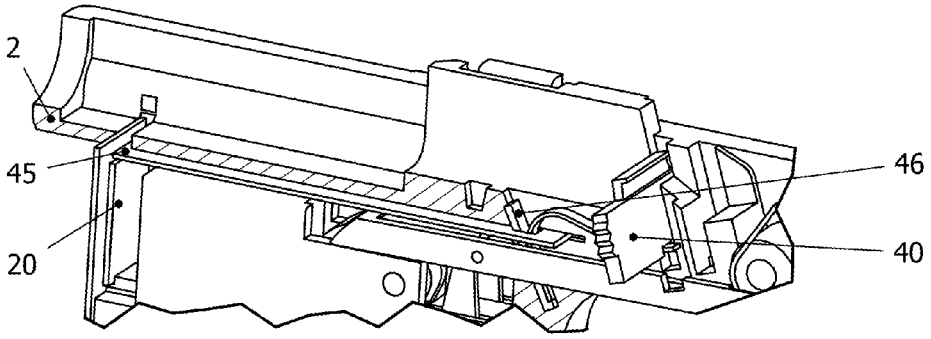
Figure 15:
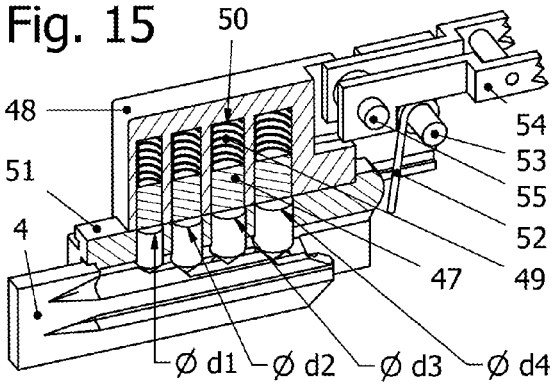
FIGS. 15 and 17 show a partial sectional representation.

FIG. 10 illustrates the status of the system in which the firearm 1 has been drawn out of the holster 3 and a grasp by the hand exerts a renewed force on the grip lever 9 after an interruption, as would occur, e.g., if the weapon 1 were to be picked up by an enemy. At this point, the firearm 1 is locked and cannot be activated without being properly inserted into the original holster 3 with the matching key 4. Because the linear lock 10 is blocked by the locking pins 15, the linear module 13 cannot move. This results in a reduction in the possibility of movement of the relevant components in relation to the turning of the locking pawl 16. Due to the specific geometry of the locking pawl 16, as shown in FIG. 12, a locking force FZ which tightens the locking pawl in a clockwise direction is generated by the force of the hand FH. It is therefore impossible to move the locking bar 17, and as a result, the locking mechanism 8 is in the locking mode 29. The deactivated state of the system is easily detectible on the grip, because the grip lever 9 protrudes out of the grip and cannot be retracted, and therefore, the grip lever 9 and the locking bar 17 coupled thereto are permanently in the locked position 39 with the blocked portion 36.

Figure 11:
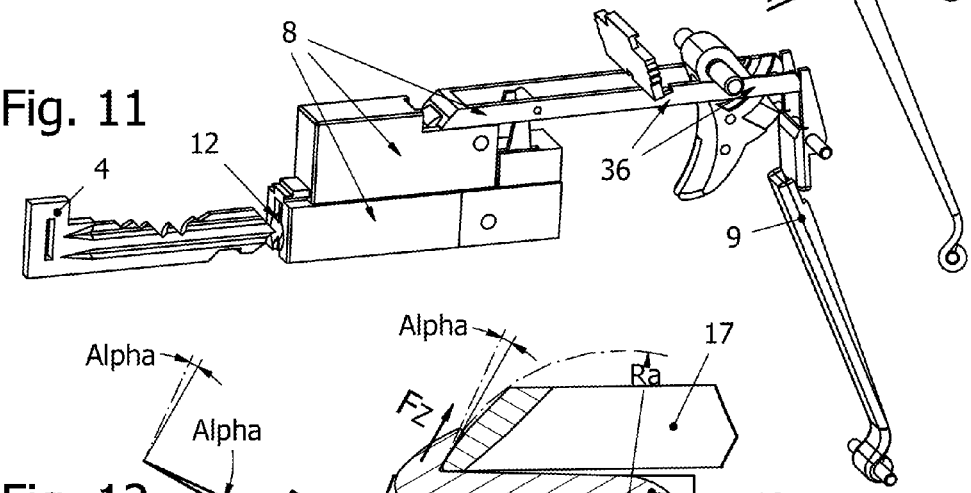

FIG. 11 shows an overview of the mechanism according to the invention without sectional illustrations, in a locked state.

FIG. 12 shows the geometry and the force conditions on the locking pawl 16 in the locking mode 29. As a result of the force of the hand FH, the radial force FR which normally acts on the tangent on the circular arc Ra around the center of the axis of rotation of the locking pawl, since a system which is mounted so as to be freely rotatable can only absorb such radial forces, is exerted on the locking pawl 16. Since the contact area between the contact barrier of the locking bar 17 and the hook of the locking pawl 16 has an inclination of the angle alpha, which is greater than 0 degrees and less than 30 degrees, from the tangent on the circular arc around the center of the axis of rotation of the locking pawl 16 as depicted, specific forces develop as shown in the vector addition, specifically the blocking force FS and the locking force FZ which tightens the locking pawl 16 in a clockwise direction.

For a more detailed view, FIG. 13 again shows the individual components of the system which is mounted in the weapon, but in an exploded view, so that it is clear how said components are constructed and how they are assembled. This illustration along with FIG. 14 will now be used in the description of the protection against dismantling. It is clear that a locking device for a firearm 1 makes sense only if it cannot be easily invalidated. Since weapons are constructed in such a way that they can be easily dismantled, which would also allow a locking device to be removed, this must be counteracted by design. In the present invention, this is accomplished as follows: Once all of the components, as are illustrated in FIG. 4 to FIG. 11, that is, the components having the reference signs 11 to 42 excluding 20, as depicted, have been installed in the firearm 1, a housing securing device 45 is pushed into a groove of the weapon body 2. The lock panel 20 is then inserted from the top and closes off the entire locking mechanism 8. The housing with the locking mechanism 8 is thereby sealed. In the next step, the inserted housing securing device 45 is shifted backwards, in the representation toward the left, coming to rest above the tab of the lock panel 20 and securing it against removal toward the top. At this point, the housing securing device 45 is also fixed in place by means of a housing securing fastener 46 so that it is no longer able to move. This housing securing fastener 46 is situated inside the weapon 1 so that it can be removed only when the weapon is opened. Since the locking slide 40 must be actuated in order to open the firearm 1 and can be actuated only if the system has been activated by means of the key 4 when the grip lever 9 is in active mode 38, the opening of the firearm 1 and a dismantling of the locking mechanism 8 are impossible without activation by means of the key 4. Therefore, the firearm 1 is also secured against unauthorized disassembly.

In the description thus far of the solution preferred by the inventor, a linear lock which corresponds in terms of the key motion link and the blocking logic thereof to a classic safety lock has been described. FIG. 15 to FIG. 18 show a solution in which a linear lock is modified so as to enable a very simple solution for the locking mechanism 8 of the firearm 1. This will also hereinafter be referred to as the simple solution. Only the modified components and processes will be depicted and discussed.

Figure 16:
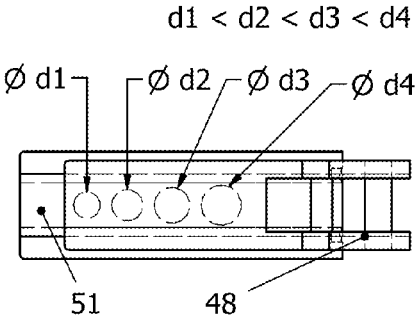
Figure 17:
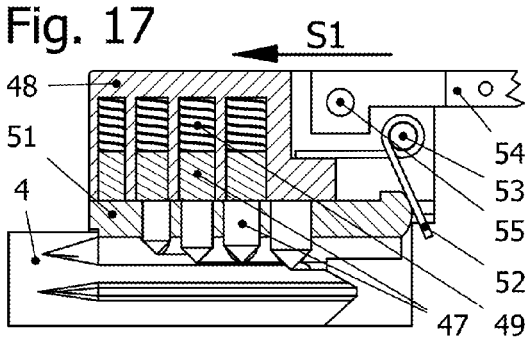
Figure 18:
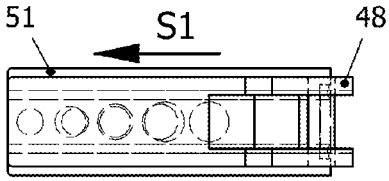

First, a general description of the system of the simple solution will be provided: Key and lock, as compared with the locking mechanism 8 of the preferred solution, are modified in the locking mechanism 8 of the simple solution as follows. The key 4 does not have a recess and therefore does not feature a hook on the bottom side for a fixing lever, and the motion link of the key 4 is modified such that it becomes narrower in the direction of the tip of the key, toward the right in the figure, as a result of which the modified locking pins 47 sit lower and lower in the direction of the tip of the key, as is clear from FIG. 15 and FIG. 17. As a result, the key 4 can be withdrawn when the system is any mode, and the key 4 is not blocked by the locking pins 47 when the linear module 48 is displaced. The locking pins 47 are modified such that the diameter of the locking pins 47 and therefore also the diameter of the respective compression springs 49 and bored holes 50 in which they are located increases opposite the direction of motion of the stroke S1. This is clear from the resting position shown in FIG. 15 and FIG. 16. If the linear module 48 is then moved to the left as a result of the stroke S1, as depicted in FIG. 17 and FIG. 18, a larger diameter always moves over a smaller diameter, thereby preventing the locking pins 47 from sliding into an incorrect hole in a lock base 51, and preventing accidental catching. FIG. 16 and FIG. 18 show only the lock base 51 and the linear module 48 separately to effectively illustrate this ratio of the diameters of the locking pins 17. The linear module 48 is held on the right side in the stop position by means of a spring, in this solution by means of a torsion spring 52 around an axis 53. The stroke of a locking bar 54 is transferred to the linear module 48 by means of a tappet 55 which projects into a groove of the linear module 48.

The modes of this simple solution, depicted in FIG. 15 to FIG. 18, are as follows: If the key 4 is in the lock base 51, the locking mechanism 8 is in the released mode 28, the locking pins 47 are leveled such that the linear module 48 can move to the left, as represented by the stroke S1, whereby the grip lever 9 reaches the active position 38 and the firearm is therefore activated. During the entire time in which the firearm 1 weapon is activated, the linear module 48 remains in a position on the left, as depicted in FIG. 17 and FIG. 18. If the pressure of the hand on the grip lever 9 when the weapon 1 is drawn and thus the key 4 is removed is then interrupted, causing the linear module 48 to move back to the right to the starting position, the upper halves of the locking pins 47 slide in their respective holes in the lock base 51 and from that moment block the linear module 48 against further shifting. Locking mechanism 8 is therefore in the locking status 29, and the grip lever 9 is in the locked position 39. The firearm 1 is therefore locked and can be re-activated only by means of the key 4. In contrast to the solution preferred by the inventor, the firearm 1 can also be drawn in a deactivated state. To prevent this from happening, this simple solution, modified accordingly, can also be combined with a fixing lever 18, as described in the solution preferred by the inventor. In addition, a linear lock with locking pins, the diameter of which increases counter to the direction of motion of the stroke, can also be used in the solution preferred by the inventor to enhance the operational reliability of said solution.

As an alternative to a linear lock, a cylinder lock can also be used. This cylinder lock differs from the conventional in that, in contrast to conventional cylinder locks, the key 4 is inserted into the fixed part. A modified locking mechanism 8 with a cylinder lock of this type for a locking device according to the invention with a push-actuated linear lock is illustrated in FIG. 19 to FIG. 26, wherein only those parts which are modified in relation to the locking mechanism 8 of the preferred solution are shown. In this, the key 4 is inserted into a lock base 56. The locking function is implemented by means of the locking pins 15 on a rotatable lock barrel 57, in which the compression springs 24 are located with a portion of the locking pins 15.

Figure 19:
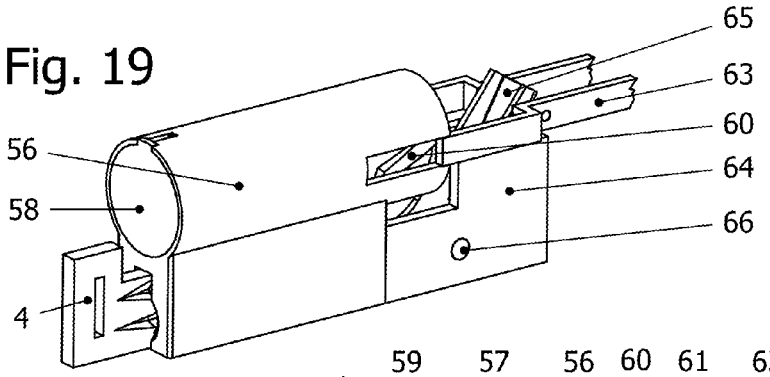
FIG. 19 shows a perspective representation and FIG. 20 shows a perspective partial section, FIG. 21 and FIG. 23 to FIG. 26 partial sectional representations of individual modes when using a cylinder lock, FIG. 22 a plan view of a lock barrel of the cylinder lock, FIG. 27 a partial sectional representation of a version with an activating lever on the rear side of a grip, FIG. 28 the mechanism according to the invention, installed in the firearm, with a linear locking mechanism under tension in a partial section, FIG. 29 to FIG. 33 individual modes of the mechanism according to the invention with a linear locking mechanism under tension in a partial section, FIG. 34 to FIG. 37 optional, expanded blocking functions in a partial section, FIG. 38 to FIG. 40 a reinforcement for the lock housing in different partial sections, FIG. 41 to FIG. 47 a safety holster with a key and a fastening mechanism in various different views, FIG. 48 to FIG. 58 individual modes of the fastening mechanism of the safety holster from various different views, FIG. 59 to FIG. 66 modes of a rotational motion link for pre-stressed triggers from different views.
Figure 20:
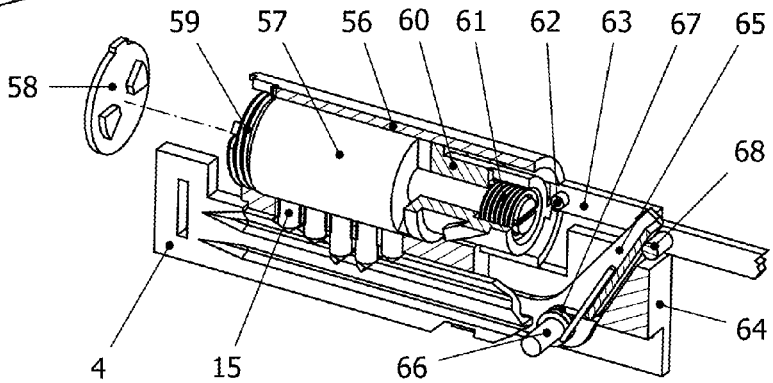

To begin with, a general description of the system will be provided in reference to FIG. 19 and FIG. 20: In the lock base 56, the lock barrel 57 is mounted so as to rotate about an angle of less than 180 degrees. This angle of rotation is delimited by stops which are affixed on a housing cover 58 that is firmly connected to the lock base 56. A torsion spring 59 holds the lock barrel 57 in the stop. On a shaft joined by the lock barrel 57 on the right, a locking cylinder 60, which is capable of rotating about an angle of less than 180 degrees, is mounted so as to rotate, wherein this angle is delimited by stops on the lock barrel 57. The locking cylinder 60 is held in the stop position by a torsion spring 61. The locking cylinder 60 has two spiral guides into which the pins 62 of a locking bar 63 engage. On the right side next to the lock base 56, a fixing lever assembly 64 is fixed in the weapon body 2, by means of which assembly a fixing lever 65 is mounted so as to rotate around an axis 66. A torsion spring 67 exerts a torque on the fixing lever 65 in the clockwise direction, which causes the locking bar 63 to be pushed toward the right by means of a locking bar tappet 68, and the left lower region of the fixing lever 65 fixes the key 4 in the system by hooking the key into the fixing lever 65.

Figure 21:
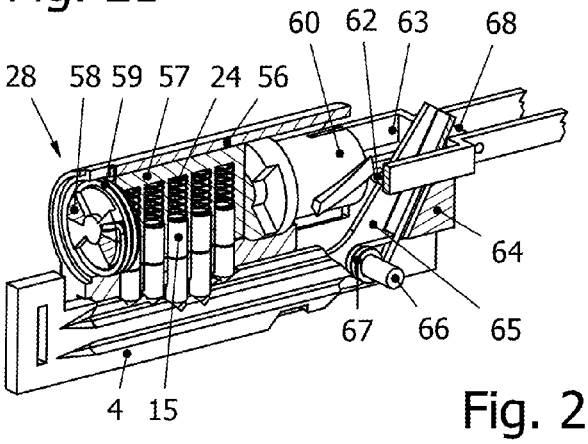
Figure 22:
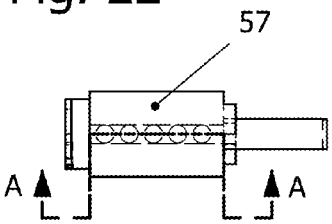

The functional sequence will now be described in reference to FIG. 21 to FIG. 26, presenting the individual modes, with FIG. 22 depicting the cross-section of the lock barrel 57, as is used in FIG. 21 and FIG. 23 to FIG. 26. These illustrations are shown as partial sections in order to provide a view of all of the functionally relevant components. The housing cover 58 has been cut in such a way that only the stops are visible. The modes are analogous to the solution preferred by the inventor and illustrated in FIG. 5 to FIG. 10, which has already been described in detail, and therefore, they will be described only in terms of their relation to the cylinder lock.

In FIG. 21 the system is in the resting state. The firearm 1 is in the holster 3, and therefore the key 4 is in the lock base 56. The separation planes of the locking pins 15 are leveled by means of the key 4, and therefore, the locking mechanism 8 is in the released mode 28. The lock barrel 57 is pressed in a clockwise direction against the stop of the housing cover 58 by means of the torsion spring 59. The locking cylinder 60 is pressed against the stop of the lock barrel 57 in a counterclockwise direction by means of the torsion spring 61. The fixing lever 65 pushes the locking bar 63 toward the right to the stop via the locking bar tappet 68 by means of the torsion spring 67. The grip lever 9 is therefore in the locked position 39.

Figure 23:
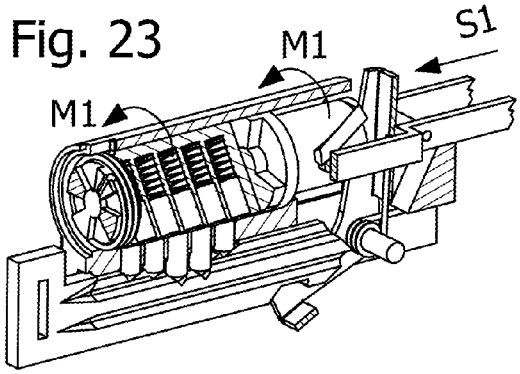

In FIG. 23 the firearm 1 is being activated. As a result of the stroke of the locking bar 63, represented by the arrow S1, the pins 62 of the locking bar 63 engage in the spiral guides of the locking cylinder 60 and turn these in a counterclockwise direction. The lock barrel 57 is turned along by the stop of the locking cylinder 60 to the lock barrel 57. This joint turning is implemented against the force of the torsion spring 59 and is represented by the two arrows M1.

Figure 24:
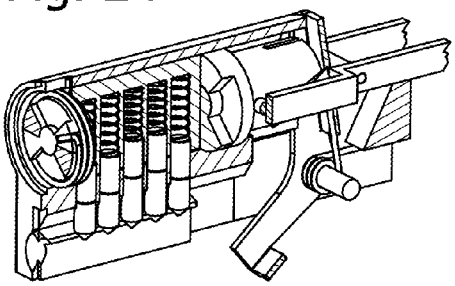

In FIG. 24 the firearm 1 is activated and has been drawn. The lock barrel 57 has been turned back by the torsion spring 59, because the pins 62 have slid over the end of the spiral guides of the locking cylinder 60, and said barrel is fixed against turning by the locking pins 15, because the key 4 has been withdrawn. The locking bar 63 is in the left stop position, and therefore, the grip lever 9 is in the active position 38, thereby enabling the functions of the firearm 1.

Figure 25:
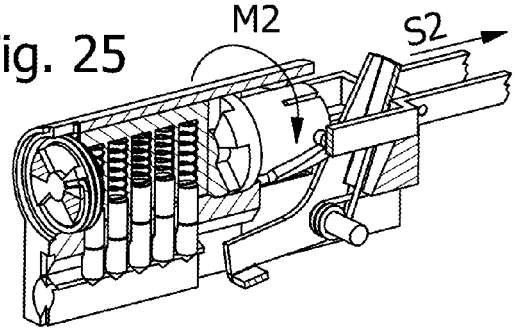

In FIG. 25, the pressure on the grip lever 9 of the firearm 1 is interrupted, causing the locking bar 63 to be pushed toward the right by means of the torsion spring 67 via the fixing lever 65. This stroke is represented by the arrow S2. In this, the pins 62 of the locking bar 63 engage into the spiral guides of the locking cylinder 60 on the side opposite the side involved in the activation and turn said bar counter to the force of the torsion spring 61 in a clockwise direction, as illustrated by the arrow M2. This takes place because, due to its dimensions, the torsion spring 61 exerts a torque which is considerably weaker than that of the torsion spring 67 via the pins 62 of the locking bar 63. In the meantime, the lock barrel 57 is fixed in place by the locking pins 15.

Figure 26:
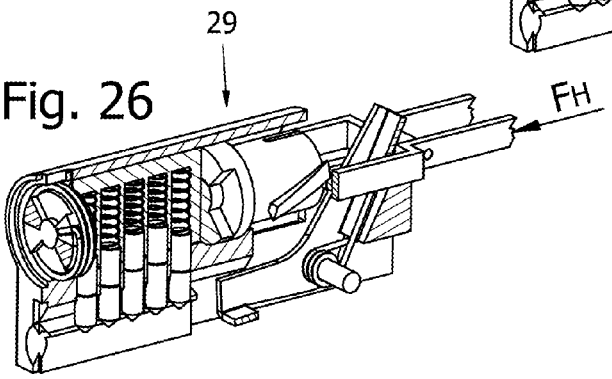

FIG. 26 illustrates the state of the system in which an unauthorized activation is being attempted. The locking cylinder has been brought back to the stop position by means of the torsion spring 61. The force of the hand, represented by the arrow FH, attempts to move the locking bar 63 toward the left. Since the locking pins 15 are fixing the lock barrel 57 against rotation, and since, due to the stop, the locking cylinder 60 can rotate together with the lock barrel 57 only in a counterclockwise direction, the locking cylinder 60 is blocked as well. Therefore, the pins 62 of the locking bar 63 cannot turn the locking cylinder 60 via the spiral guides and are therefore blocked by said cylinder, which causes the locking mechanism 8 to be in the locking mode 29. The locking bar 63 cannot move toward the left, which causes the grip lever 9 to remain in the locked position 39, and an activation of the firearm 1 is not possible, it is locked.

As with the linear lock, the cylinder lock can also be used in a simple solution. This simple solution of the cylinder lock is implemented with suitable modifications similarly to the simple solution of the linear lock; a separate representation has therefore been dispensed with. In this case, the key 4 is modified as in the simple solution of the linear lock such that it becomes narrower and narrower in the direction of the tip of the key, causing the locking pins to sit deeper and deeper in the direction of the tip of the key, whereby the key 4 can be removed at any time. The locking pins do not need to be modified and can have the same diameters, because one cannot be above the other in a cylinder lock. In contrast to the cylinder lock shown in FIG. 19 to FIG. 26, this simple solution does not require a locking cylinder. The guide grooves are mounted directly on the lock barrel and turn it directly against a spring. As a result, all modes function similarly to the simple solution with the linear lock. The simple solution with the cylinder lock can also be implemented with or without the fixing lever.

Figure 27:
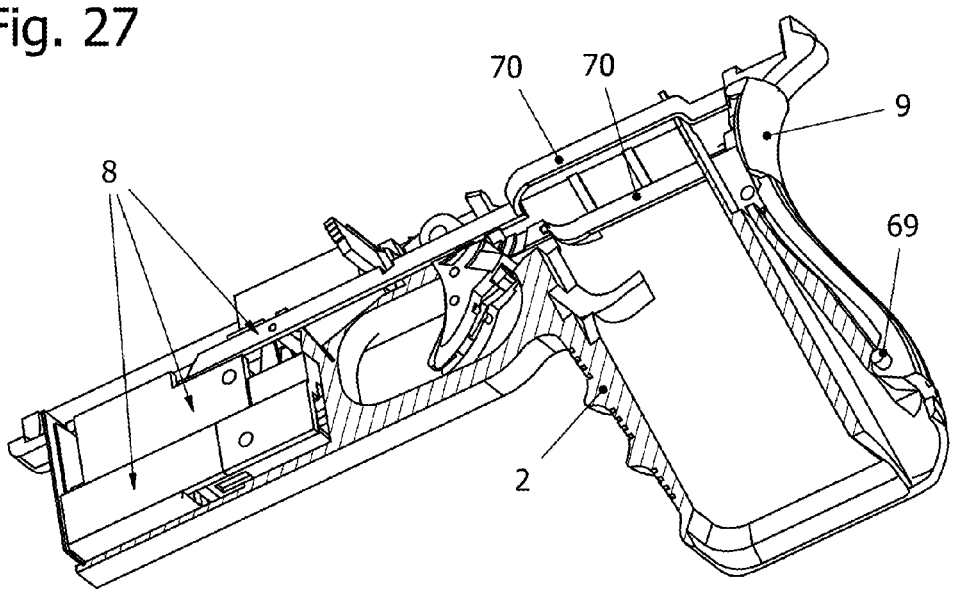

The solution preferred by the inventor and described above was implemented using an activation element 9, embodied as a grip lever 9, on the front side of the grip of the weapon body 2. Alternatively, the activation element 9 can be mounted at any location on the firearm 1 where a hand can be detected. An obvious variant would be to mount it on the back side of the grip. A solution of this type is shown in FIG. 27. In this case, the pressure which is exerted by the hand is received by an activation element 9, embodied as a modified grip lever 9, which is mounted so as to rotate around an axis 69, and said pressure is transferred to the locking bar 17 by two bridges 70 which run around the magazine shaft of the firearm 1.

Figure 28:
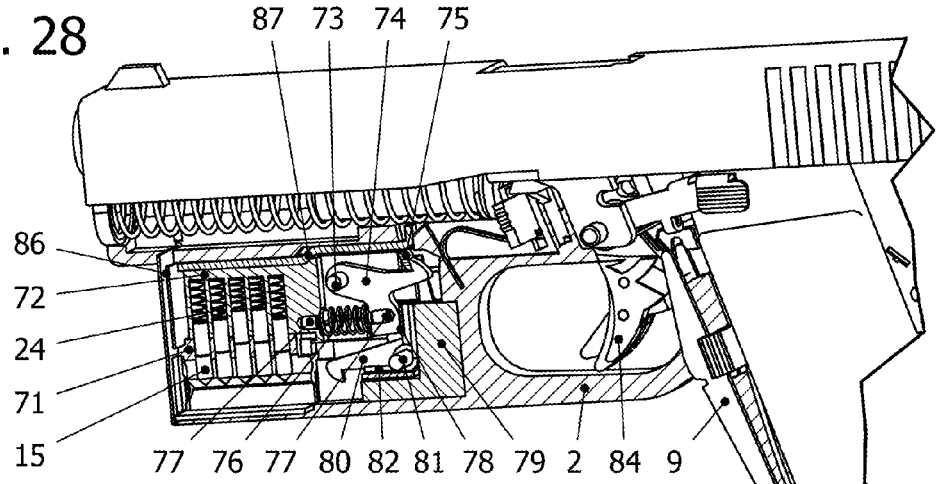
Figure 29:
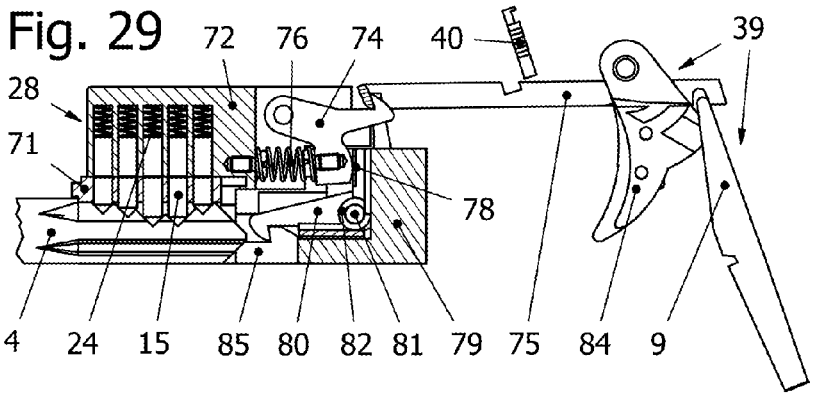
Figure 30:
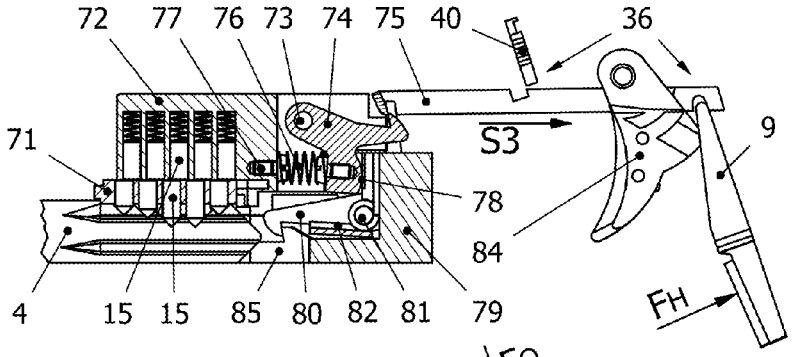

In contrast to the solutions presented thus far, all of which are characterized by a push actuated activation stroke, represented by the arrow S1, FIG. 28 to FIG. 33 illustrate a solution involving a pull-actuated activation stroke, represented by the arrow S3 in FIG. 30. FIG. 28 shows such a modified locking unit 5 with a corresponding locking mechanism 8 and an activation element 9, implemented as a modified grip lever 9, built into a firearm 1, and the illustrations in FIG. 29 to FIG. 33 show the isolated solution according to the invention in its functional sequence. This functional sequence will be described once more in reference to the individual diagrams, wherein only the differences and the new aspects as compared to the preceding solutions will be described explicitly:

First, a general description of the system will be provided in reference to FIG. 28: Similarly to the push-actuated locking mechanism 8 which has already been described, the pull-actuated locking mechanism 8 also consists of a lock base 71 which is fixed in the weapon body 2 and is connected to the linear module 72 by grooves such that the linear module can slide. On an axis 73 which is fixed on the linear module 72, a locking pawl 74 is rotatably mounted and controls a locking bar 75. A compression spring 76, which is positioned by means of the heads of two screws 77, pushes the locking pawl 74 in a counterclockwise direction. Since the locking pawl 74 is supported by a contact plate 78 which is mounted on a fixing lever assembly 79, the compression spring 76 simultaneously pushes the linear module 72 toward the left against a stop in the resting position. A fixing lever 80 is rotatably mounted on an axis 81 which is fixed to the fixing lever assembly 79. The fixing lever 80 is pushed by a torsion spring in a counterclockwise direction, so that it pushes the locking bar 75 toward the left to the stop position. The modified grip lever 9 is mounted so as to rotate around an axis 83 and hooks directly into the locking bar 75. In this position, the grip lever 9 is in the locked position 39, and therefore, the functions of the firearm 1 are blocked. An adapted trigger 84 is part of the triggering mechanism 22 which is part of the firearm 1 that serves as an example.

FIG. 29 shows the status of the system in which the firearm 1 is in the holster 3 in the carrying position, free of external influences or forces. The key 4 is in the lock base 71 and the locking mechanism 8 is therefore in the released mode 28. The locking pawl 74 pushes the linear module 72 toward the left against the stop of the lock base 71 by means of the compression spring 76. The locking bar 75 is in the stop position on the left side, whereby the trigger 84 and the locking slide 40 are blocked. The grip lever 9 is in the stop position in the counterclockwise direction and is therefore in the locked position 39. The fixing lever 80 is in the stop position and is therefore hooked into a fixing hook 85. This fixing hook 85 is located parallel to the key 4, in the illustration behind it, and is fixed in the holster body 6, just like the key 4. As a result, the firearm 1 is fixed in the holster 3 and cannot fall out of it.

FIG. 30 shows the status of the system in which the firearm 1 in the holster 3 is being activated by the grasp of the hand. As a result of the force exerted by the hand FH, represented by an arrow, a torque is exerted on the grip lever 9 which pushes the locking bar 75 toward the right against the pressure of the two springs 76 and 82, moving the locking bar 75 to the right. This stroke is represented by the arrow S3. As a result of this motion, the locking pawl 74 turns in a clockwise direction until it releases the locking bar 75 completely. The fixing lever 80 is turned by the locking bar 75 in a clockwise direction and thereby opens the securing of the fixing hook 85 by the hook thereof.

Figure 31:
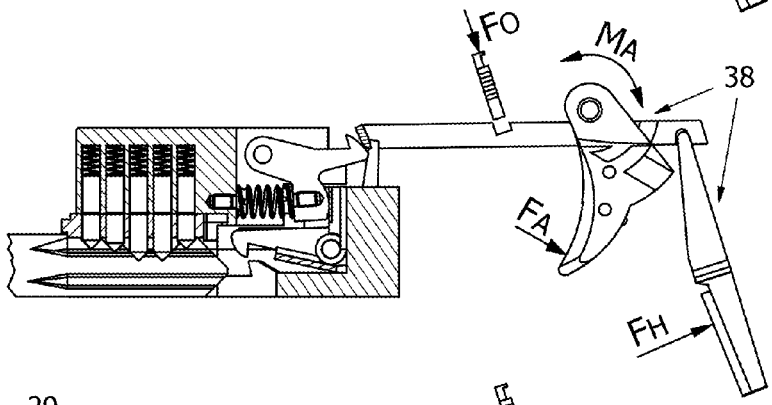

FIG. 31 illustrates the status of the system in which the firearm 1 in the holster 3 is activated by being accessed by the hand and the resulting pressure exerted on the grip lever 9. The grip lever 9 is pushed by the force of the hand, represented by the arrow FH, up to the stop into the active position 38, thereby moving the locking bar 75 as far as possible to the right. As a result, the rotational motion link for the trigger 84 and the recess for the locking slide 40 on the blocking portion 36 of the locking bar 75 are in the released position. Now, only the spring force of the torsion spring 82 acts as a counterforce via the fixing lever 80. As a result of the compression spring 76, the locking pawl 74 has turned back in the counterclockwise direction into the expansion space behind the contact barrier of the locking bar 75, thereby simultaneously also bringing the linear module 72 back to the stop position on the left side. The axes of the divided locking pins 15 are congruent again, and therefore, the locking pins 15 can also move back in their axial direction and the key 4 can therefore be withdrawn. At the same time, the fixing lever 80 has also simultaneously released the hook of the fixing hook 85 completely. As a result, the firearm 1 can be drawn out of the holster 3, and once the weapon 1 has been drawn from the holster 3, the trigger 84 can be actuated by means of a pulling force, represented by the arrow FA, which releases a shot as a result of the torque, represented by the arrows MA. The locking slide 40 can also be actuated by means of an opening force, represented by the arrow FO, allowing the firearm 1 to be disassembled.

Figure 32:
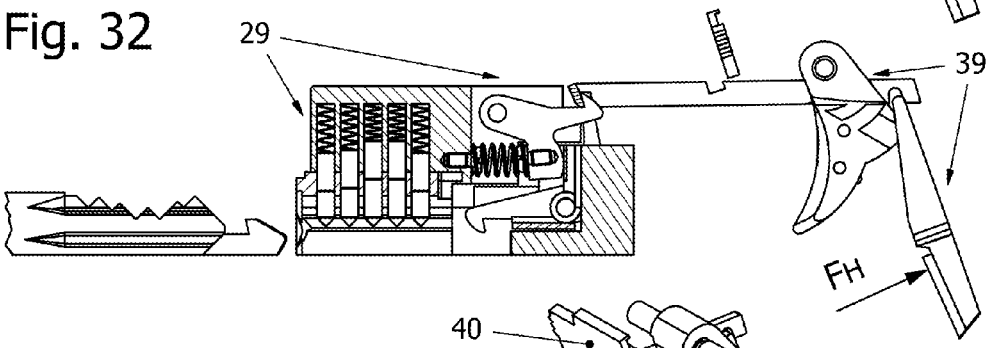
Figure 33:
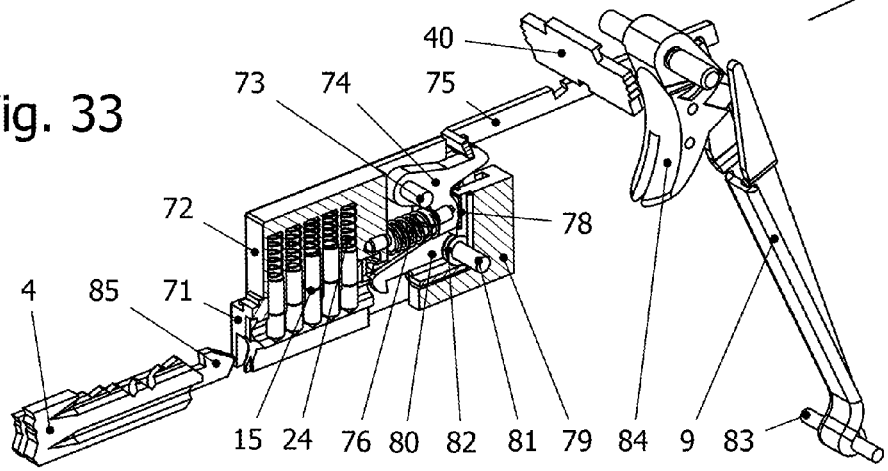
Figure 34:
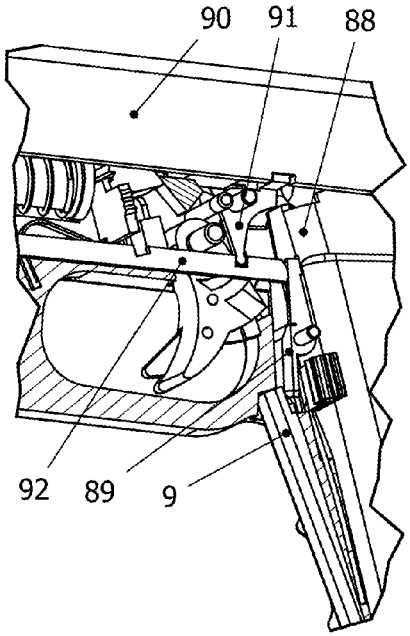

If the force is then interrupted by the hand FH on the grip lever 9, the grip lever will move to the locked position 39. The locking bar 75 is pushed toward the left by the torsion spring 82 by means of the fixing lever 80, causing the contact barrier of the locking bar 75 to briefly turn the locking hook 74 in a clockwise direction, so that it hooks into the contact barrier again, because the force which results from the torsion spring 82 is considerably greater than that of the compression spring 76. As a result, the status of the system which is illustrated in FIG. 32 and FIG. 33 is achieved. If pressure is then exerted on the grip lever 9 anew, the locking bar 75 will be unable to move, as it is hooked into the locking hook 74 which cannot move, because the locking pins 15 of the lock are in the locking position without the key 4, and therefore, the locking mechanism is in the locking mode 29. Therefore, the grip lever 9 is permanently in the locked position 39 and the weapon is deactivated.

In this solution involving a pull-actuated locking mechanism, a modified dismantling protection is employed, as is also illustrated in FIG. 28. In this, the tab of a lock panel 86 is implemented as a flexible flap, which bounces back slightly after being inserted from above and hooks into the weapon body 2, positioning it securely and preventing it from simply being pulled out again. By means of a safety slide 87 this spring-mounted tab of the lock panel 86 can be pressed together such that it fits back through the slot through which it was inserted from the top. For this purpose, the safety slide 87, which is accessible only if the weapon 1 is opened, is pushed toward the left.

Naturally, the solution of the pull-actuated locking mechanism, like the push-actuated locking mechanism, can also be implemented as a simple solution. In addition, the pull-actuated solution can also be designed with a cylinder lock. For this purpose, it is necessary only to reverse the gradient of the spiral guides of the locking cylinder 60.

Figure 35:
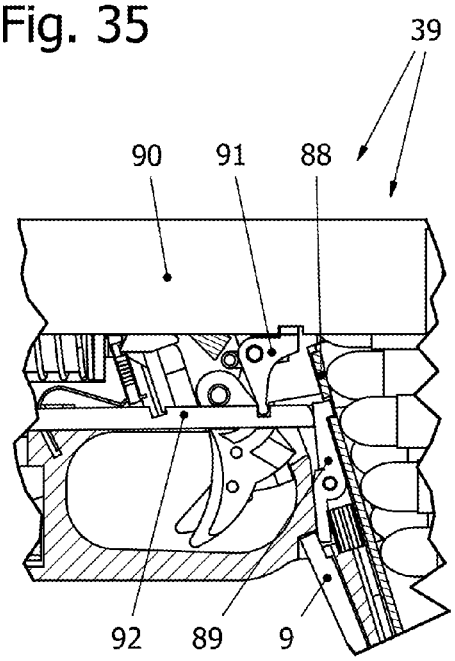
Figure 36:
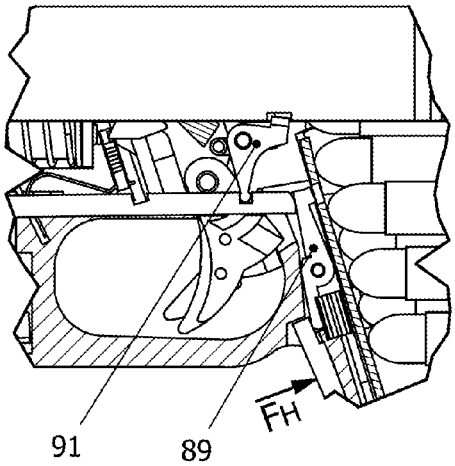
Figure 37:
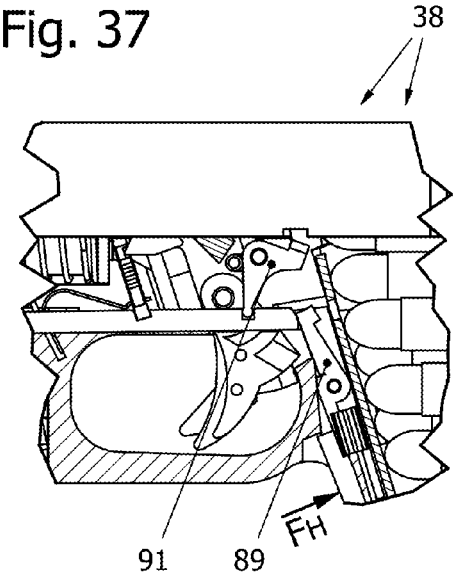

Optionally, additional functions and/or movements of the components of the firearm 1 can be locked by means of the locking device according to the invention, if necessary. In FIG. 34 to FIG. 37, this is illustrated based exclusively on the solution preferred by the inventor. These optional lock enhancements are not included in the other illustrations. One of these enhancements involves locking a magazine 88 against removal, in which pins on a bell crank lever 89 protrude into the magazine 88 and fix it in the locked position. In addition, a slide 90 will be blocked if the tongue of a slide fixing device 91 projects into a recess of the slide 90 and prevents it from moving. As a result, the slide 90 cannot be worked, and therefore, the next cartridge cannot be loaded. The functional sequence is illustrated in FIGS. 35 to 37. In FIG. 35, the grip lever 9 is in the locked position 39 and the firearm 1 is therefore in a locked mode, the pins of the bell crank lever 89 protrude into the magazine 88, and the tongue of the slide fixing device 91 protrudes into the slide 90. In FIG. 36, the firearm 1 is activated by the pressure exerted by the hand FH, represented by an arrow, on the grip lever 9. The bell crank lever 89 turns in a counterclockwise direction, which causes the pins of the bell crank lever 89 to move out of the recesses of the magazine 88. A locking bar 92 moves toward the left, thereby turning the slide fixing device 91 in a clockwise direction and releasing the slide 90. In FIG. 37, the grip lever 9 is in the active position 38 and the firearm 1 is therefore activated and the functions are enabled, with both the slide 90 and the magazine 88 being freely moveable.

Figure 38:
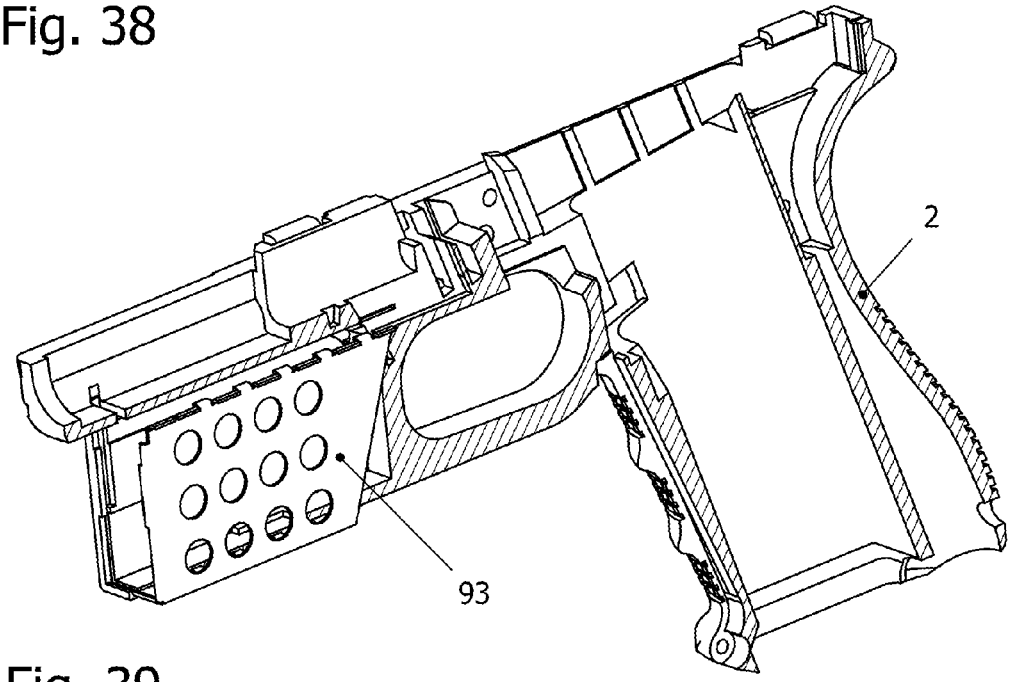
Figure 39:
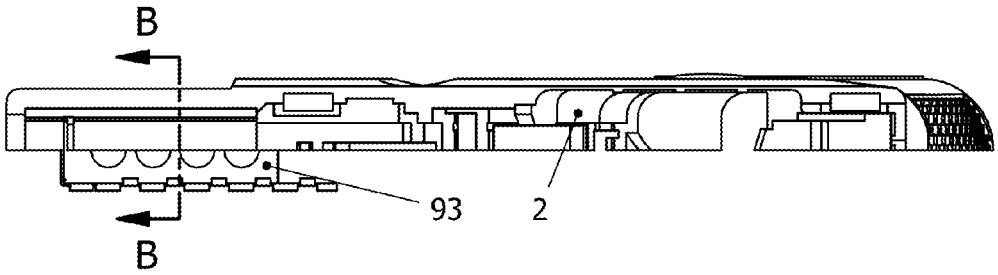
Figure 40:
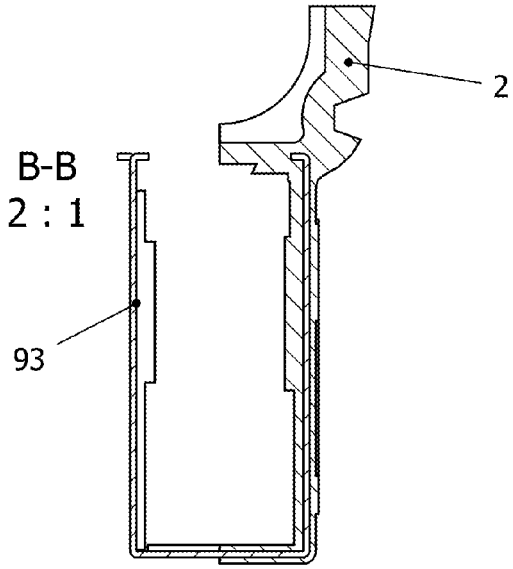
Figure 41:
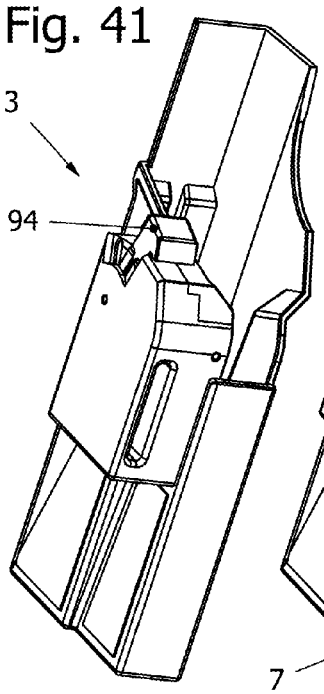

To protect the locking system against manipulation, it is advisable to reinforce the weapon body 2 around the locking mechanism 8 by means of a sheet metal part, especially if the weapon 1 has a weapon body 2 which is made of plastic. One solution for reinforcement 93 is illustrated in FIG. 38 to FIG. 40, wherein the weapon body 2 is generally shown in cross-section so as to show the reinforcement 93 in its position. The reinforcement 93 is designed such that a closed metal surface is located in the region of the essential locking mechanism. Where possible, the metal surface is interrupted by holes in order to keep the plastic body as homogenous as possible. On the left side, the edges are bent upward in order to also reinforce the slide by means of the lock panel 20 or 86.

Figure 42:
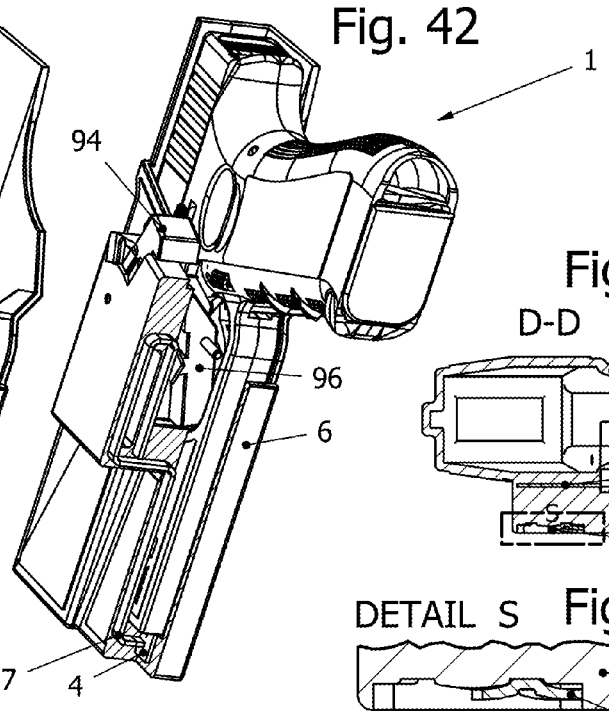
Figure 43:
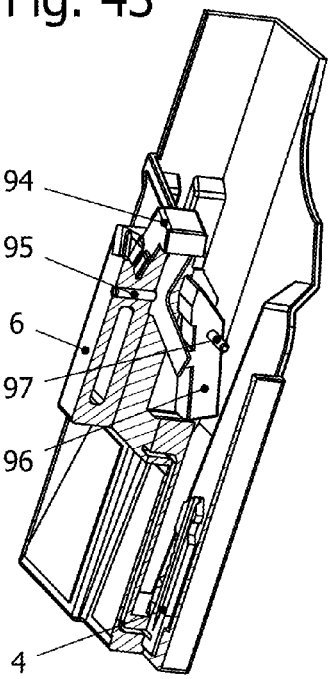
Figure 44:
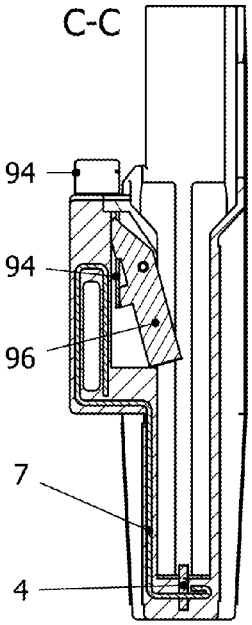

In this solution which is preferred by the inventor, a safety holster 3 is employed as an unlocking unit 3, as a counterpart to the firearm 1 in which the locking unit 5 is installed, with the release element 4, implemented as a key 4, being mounted in said holster. As is clear from FIG. 42 to FIG. 44, this key 4 is welded into the holster body 6 and is thereby simultaneously fixed in place by the key mount 7. This key mount 7 is also welded into the material of the holster 3 and in this solution preferred by the inventor is formed such that it also reaches around the belt flap of the holster 3, which makes it impossible to break the key 4 out of the holster. The firearm 1 is generally fixed in place in the holster 3 by a fixing lever 18, as depicted in the previous illustrations. This securing method is reasonable, but in the context of the invention it is not sufficient for protecting a firearm 1 which is carried in an open holster against unauthorized access, since an unauthorized individual can reach for it at a moment's notice. Therefore, additional protection is required on the side of the holster 3 to largely protect the firearm 1 in accordance with the invention against unauthorized access.

Figure 46:
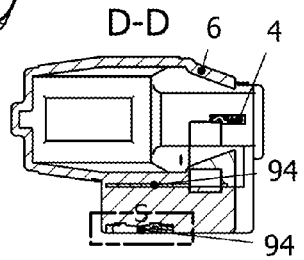
Figure 47:
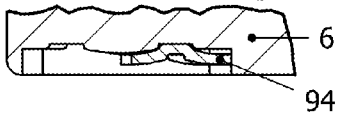
Figure 45:
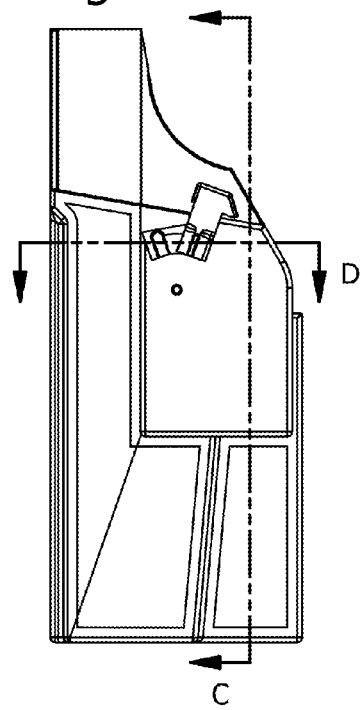
Figure 48:
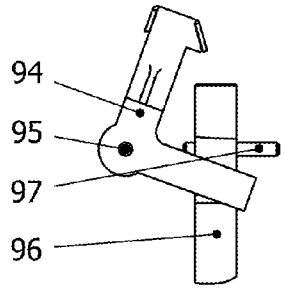
Figure 49:
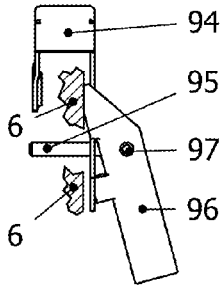
Figure 50:
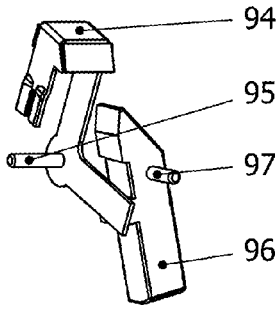

This specific protection will be explained in the following in reference to FIG. 41 to FIG. 58. The holster protection consists of only 4 components: A safety catch 94 which is mounted so as to rotate around a first axis 95 and is used to control the safety, and a fixing flap 96, which is mounted so as to rotate around a second axis 97, wherein the function of the fixing flap 96 is to fix the weapon body 2 in place. The safety catch 94 has two possible positions, in the front and in the back, which can be occupied when the springing part of the safety catch 94 latches into a corresponding motion link of the holster body 6, as depicted in FIG. 45 to FIG. 47, cross-section D-D and the detail S thereof. At this point, the positions and the function of this construction will be presented and explained in FIG. 48 to FIG. 58 in reference to the isolated safety mechanism. FIGS. 49, 52, 54 and 56 each show a side view of FIGS. 48, 51, 53 and 55. The home position of the safety catch 94 for the carrier of the firearm 1 is located at the back, which corresponds to the right side of the illustration as represented identically in FIG. 41 to FIG. 43, FIG. 45 to FIG. 48, FIG. 50, FIG. 57 and FIG. 58, wherein the fixing flap 96 projects into the holster body 6 and thereby into the recess of the weapon body 2 for the trigger, as is clear from FIG. 42, making removal of the weapon 1 impossible. As a result of the specific embodiment of the construction, the fixing flap 96 is blocked by the safety catch 94, so that it cannot be moved, as is clear from FIG. 44 and FIG. 49, because it is clamped between the stops on the holster body 6 and on the safety catch 94. FIG. 48 shows the front view, FIG. 49 the side view and FIG. 50 the perspective view of this system status of the isolated safety mechanism of the holster 3.

Figure 51:
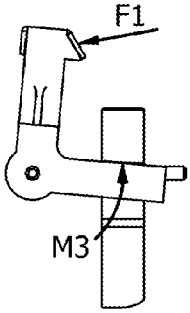
Figure 52:
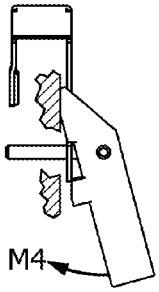
Figure 57:
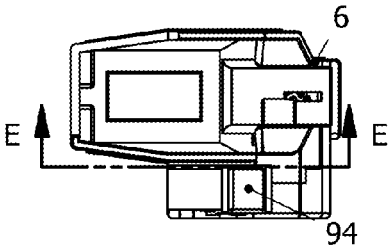

If the safety lever 84 is then pushed forward by the force F1, as represented in FIG. 51 as an arrow to the left, the safety catch 94 is turned in a counterclockwise direction, represented by the arrow M3. As a result of this movement, the safety catch 94 releases the movability of the fixing flap 96 before turning it in a clockwise direction, as indicated in FIG. 52 by the arrow M4, to the vertical, in which the top edge of the lever arm of the safety catch 94 hooks into the upper catch of the fixing flap 96 and carries it along. FIG. 52 illustrates this process in the side elevation of FIG. 51.

Figure 53:
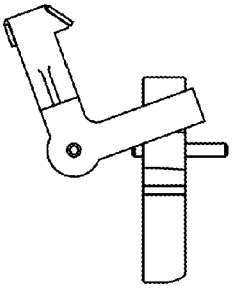
Figure 54:
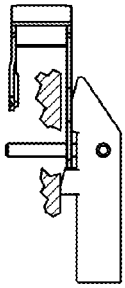
Figure 58:
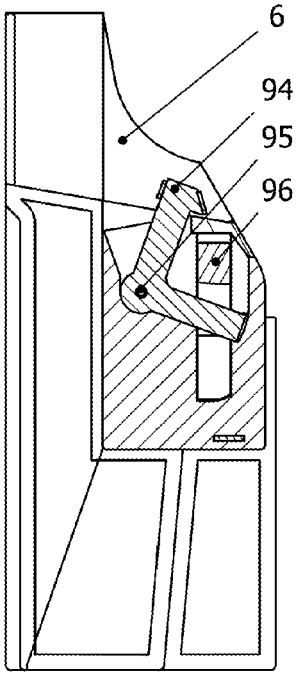
Figure 55:
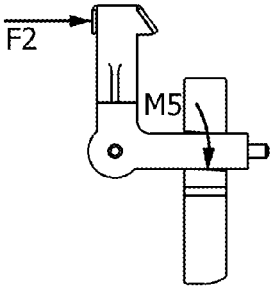
Figure 56:
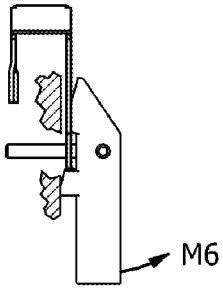

As soon as the fixing flap 96 reaches the vertical and therefore also the stop for the vertical of the holster body 6, this upper catch will create a space, so that the safety catch 94 can be moved further and the lever arm of the safety catch 94 finally fixes the fixing flap 96 in the vertical position by means of the stop on the holster body 6 and the stop on the safety catch 94, as depicted in FIG. 53 and FIG. 54. The fixing flap 96 is now in a folded-in position and the firearm 1 can be removed. The holster 3 is re-locked in a similar manner, but in the opposite direction, in that, in a movement in the opposite direction toward the back, illustrated in FIG. 55 by the force F2 as an arrow toward the right, the turning in the counterclockwise direction, represented by the arrow M5, causes the bottom edge of the lever arm of the safety catch 94 to hook into the lower catch of the fixing flap 96 as depicted in FIG. 55 and FIG. 56, and moves it downward, turning the fixing flap 96 in a counterclockwise direction, represented by the arrow M6, into the holster 3, until it reaches the position of FIG. 48 to FIG. 50 again and, as a result, the firearm 1 is locked in the holster 3.

Weapons featuring a pre-stressed trigger, as is used as an example in the solution preferred by the inventor, the rotational motion link, which blocks or releases the trigger, must be designed in such a way that it blocks the locking bar after an unauthorized attempt to fire a shot in order to avoid undefined conditions of the triggering mechanism 22, part of which is the trigger. This can occur if the trigger dips partly into the motion link even if it is in the locked position or the locked mode 39 of the activation element 9. The function of two such motion links is illustrated in FIG. 59 to FIG. 66 by means of a push-actuated locking mechanism 8. FIG. 59 to FIG. 62 depict a positive motion link on the trigger, in which the motion link projects out of the trigger body, and FIG. 63 to FIG. 66 depict a negative motion link, in which the motion link is recessed in the trigger body.

Figure 59:
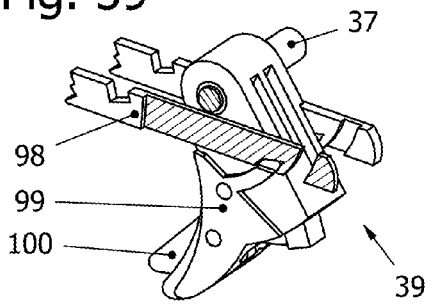
Figure 60:
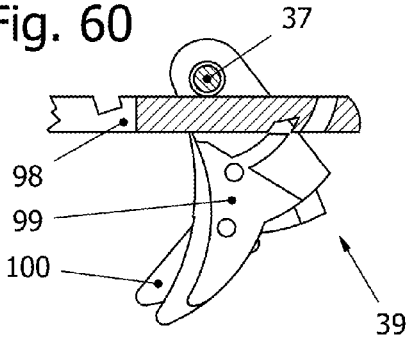

FIG. 59 and FIG. 60 show the system with the positive motion link in the locked position or locked mode 39. A locking bar 98 is in the stop position on the right side, and a trigger 99 is not actuated, as is clear from a trigger safety 100 which is folded out.

Figure 61:
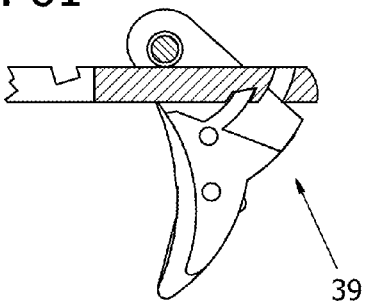

FIG. 61 shows the system following an attempt at firing a shot in the locked position or locked mode 39. Since the locking bar 98 is still in the position on the right, the rotational motion link of the trigger 99 moves into the small recess of the counter motion link on the locking bar 98, and is blocked by it. An angle of the trigger 99 which is large enough to trigger a shot is thereby prevented. The motion link of the trigger 99 simultaneously blocks the locking bar 98 as well, so that it can no longer be moved. An undefined status of the firearm 1 is thereby prevented. To reactivate the firearm 1, the trigger 99 must first be returned to its pre-stressed home position with a folded-out trigger safety 100, which is normally implemented by working the slide 90 of the firearm 1. Once this process has been completed, the firearm 1 can be activated normally again.

Figure 62:
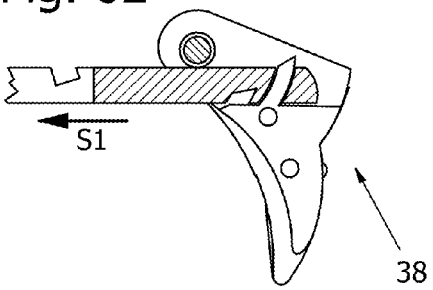

FIG. 62 shows the system in the active position or active mode 38 when a shot is being fired. The locking bar 98 is in the stop position on the left, on account of the activation stroke which is represented by the arrow 51, and therefore, the counter motion link on the locking bar 98 is in the releasing position and the trigger 99 can turn up to the maximum radial stop, thereby firing a shot.

Figure 63:
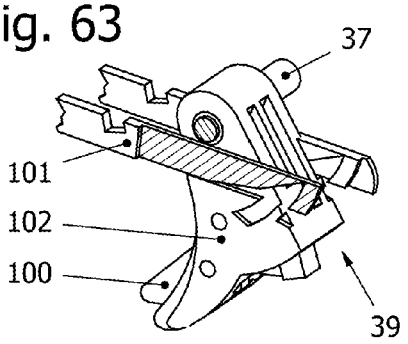
Figure 64:
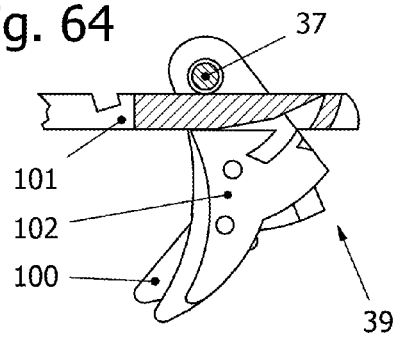

The negative motion link also behaves in a similar manner. FIG. 63 and FIG. 64 show the system with a negative motion link in the locked position or the locked mode 39. A locking bar 101 is in the stop position on the right, and a trigger 102 is not actuated, as is also clear on account of the folded-out trigger safety 100.

Figure 65:
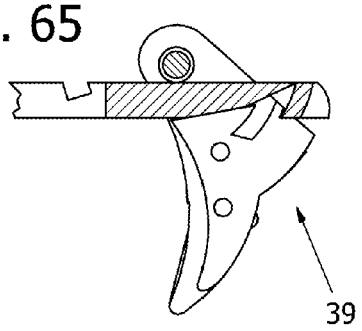

FIG. 65 shows the system following the attempt at firing a shot in the locked position or the locked mode 39. Since the locking bar 101 is still in the position on the right, the rotational motion link of the trigger 102 retracts into the recess of the counter motion link on the locking bar 101 and is blocked by it due to its shape. An angle of the trigger 102 which is large enough to release a shot is thereby prevented. At the same time, the motion link of the trigger 102 blocks the locking bar 101 as well, so that it can no longer be moved. As a result, an undefined status of the firearm 1 is prevented. In order to reactivate the firearm 1, the trigger 102 must first be returned to its pre-stressed home position with the folded-out trigger safety 100, which is normally carried out by working the slide 90 of the firearm 1. After this process, the firearm 1 can be activated normally again.

Figure 66:
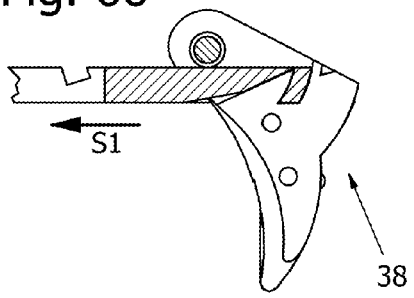

FIG. 66 shows the system in the active position or active mode 38 as a shot is being fired. The locking bar 101 is in the stop position on the left side as a result of the activation stroke, represented by the arrow S1, and therefore, the counter motion link on the locking bar 101 is in the released position and the trigger 102 can rotate to the maximum angle stop and can thereby fire a shot.

The invention claimed is:

1. A locking device for firearms for enabling releasable locking by blocking or interrupting a triggering mechanism of a firearm, the locking device comprising:

a locking unit arranged on the firearm, wherein the locking unit comprises at least one locking mechanism, and a release element embodied as separate from the firearm, the locking unit further featuring at least one activation element that is actuable by a user, wherein the activation element is coupled with the triggering mechanism of the firearm in such a way that when the activation element is in a locked position or in a locked mode, the triggering mechanism for firing a shot is blocked, and when the activation element is in an active position or in an active mode, the triggering mechanism is releasable, and wherein, when the locking mechanism is in a locking mode, the activation element is blocked from moving or being moved from the locked position or the locked mode to the active position or the active mode, and wherein the locking mechanism has a locking mechanism coupling region and wherein the release element features a release element coupling region that corresponds to said release element, and wherein when the locking mechanism coupling region and the release element coupling region are coupled, the locking mechanism switches from the locking mode to the release mode, so that, for the duration of the release mode, the activation element is movable by the user from the locked position or locked mode which blocks or interrupts the triggering mechanism of the firearm to an active position or active mode which releases the triggering mechanism of the firearm, wherein the release element is arranged in an unlocking unit that is separable from the firearm, wherein the release element is fixed to or integrated in the unlocking unit, wherein the unlocking unit can be a holster or storage container or support device, in which the firearm is at least partially insertable, by which thus rendering the firearm impossible to fire as long as the release element is contacting the locking unit, which leads to the locking mechanism coupling region and the release element coupling region being coupled, but only after separating the coupling of the locking mechanism coupling region and the release element coupling region and therefore separating the unlocking unit and the release element from the locking unit the firearm can be used, wherein:

the activation element is movable by the user to an active position or active state by grasping a grip of the firearm by the user's hand and is held in the active position or active mode, as long as the user's hand is grasping the grip of the firearm, even when the locking mechanism coupling region and the release element coupling region are decoupled by separating the release element from the locking unit, and the activation element switches to the locked position or the locked mode, as soon as the user's hand releases the grip of the firearm.

2. The locking device according to claim 1, wherein the locking mechanism coupling region is designed as an opening region, and the release element coupling region is designed at least as a sub-region of the release element, wherein the locking mechanism coupling region and the release element coupling region cooperate by the insertion of the sub-region of the release element into the opening region.

3. The locking device according to claim 1, wherein the locking unit can be mounted on the firearm.

4. The locking device according to claim 1, wherein the locking unit is integrated into the firearm.

5. The locking device according to claim 4, wherein the firearm features an opening into which the release element can be inserted at least into the first locking mechanism coupling region in order to interact with the locking unit.

6. The locking device according to claim 1, wherein the locking mechanism comprises a mechanical lock.

7. The locking device according to claim 1, wherein the locking mechanism comprises a mechanical pin lock.

8. The locking device according to claim 1, wherein the locking mechanism comprises a linear lock.

9. The locking device according to claim 1, wherein the release element is designed as a mechanical key.

10. The locking device according to claim 1, wherein the activation element is designed as a mechanical sensing element.

11. The locking device according to claim 10, wherein the activation element is designed as a mechanical lever arm.

12. The locking device according to claim 10, wherein a restoring element is provided, wherein the restoring element exerts a restoring force on the activation element, pushing the activation element into the locked position.

13. The locking device according to claim 1, wherein the firearm features a grip, and the activation element is arranged on the grip.

14. The locking device according to claim 1, wherein the grip features an external side that faces the palm of the user and an opposite, internal side that is averted from the palm of the user, and the activation element is arranged on the internal side.

15. The locking device according to claim 1, wherein the grip features an external side that faces the palm of the user and an opposite, internal side that is averted from the palm of the user, and the activation element is arranged on the external side.

16. The locking device according to claim 1, wherein, if the activation element is in a locked position or a locked mode, a dismantling mechanism of the firearm is blocked or locked.

17. The locking device according to claim 1, wherein the locking device activates or deactivates a locking device or safety device already existing in the firearm by the locking unit.

18. The locking device according to claim 1, wherein, in a firearm which essentially has a weapon body made of plastic, the locking unit is protected by a reinforcement in the weapon body, whereby the reinforcement is made of a material which is harder than the plastic of the weapon body.

19. The locking device according to claim 1, wherein the release element is a mechanical key, and the locking mechanism features at least one corresponding linear lock and a locking bar, wherein the linear lock consists of a lock base and a linear module which is mounted so as to slide or move along the lock base, wherein the lock base features an opening region which points toward the first coupling region, into which opening region at least one locking pin of the linear lock projects, each said pin being located in a respective bored opening, wherein the locking pin is embodied in two parts, and the respective bored opening extends from the linear module into the lock base, and one spring element forces the at least one locking pin into a first position in the direction of the opening region, wherein inserting the key into the opening region shifts the at least one locking pin against the spring force of the spring element into a second position, and in the second position the separation plane which divides the at least one locking pin and is located between the two parts of the locking pin is aligned parallel to a sliding plane that is located between lock base and linear module, thereby enabling a sliding movement of the linear module in order to release an opening movement in which the activation element shifts the linear module via the locking bar that is coupled to the activation element, wherein if the activation element is in the locked position a trigger which is assigned to the triggering mechanism is blocked in that the locking bar has at least one blocking portion which blocks an actuation of the trigger when the activation element is in the locked position, and releases the actuation of the trigger if the activation element is in the active position.

20. The locking device according to claim 1, wherein the activation element is implemented as an electronic sensor, in particular as an ultrasonic sensor.

21. A firearm having a locking device according to claim 1.

22. A method for releasing a lock on a triggering mechanism of a firearm according to claim 1, comprising the steps of coupling the locking mechanism coupling region and the release element coupling region so that the locking mechanism alternates from the locking mode to a release mode, and moving the activation element, for the duration of the release mode, from the locked position or locked mode, which blocks or interrupts the triggering mechanism of the firearm, to an active position or active mode which releases the triggering mechanism of the firearm by the user's hand grasping the grip of the firearm, and separating the release element from the locking unit by separating the firearm from the unlocking unit, which results in decoupling locking mechanism coupling region and the release element coupling region, while maintaining the active position or the active mode of the activation element, by the user's hand grasping the grip of the firearm, in order to enable the use of the firearm, and switching of the activation element to the locked position or the locked mode, by the user's hand releasing the grip of the firearm.

* * * * *